United States Patent [19]

Meckler

[11] 4,084,389

[45] Apr. 18, 1978

[54] AIR CONDITIONING APPARATUS

[76] Inventor: Gershon Meckler, 7425 Democracy Blvd. Unit 212, Bethesda, Md. 20034

[21] Appl. No.: 735,548

[22] Filed: Oct. 26, 1976

Related U.S. Application Data

[63] Continuation of Ser. No. 572,792, Apr. 29, 1975, abandoned.

[51] Int. Cl.[2] ..... F25D 17/00; F25D 17/06; F24F 7/00; F24F 13/00

[52] U.S. Cl. ..... 62/179; 62/411; 98/38 D; 236/13

[58] Field of Search ..... 236/12 A, 13; 98/38; 165/39; 62/179, 180, 409, 411

[56] References Cited

U.S. PATENT DOCUMENTS

| | | | |
|---|---|---|---|
| 2,622,406 | 12/1952 | Scofield et al. | 62/179 |
| 3,114,505 | 12/1963 | Kennedy | 236/13 |
| 3,116,016 | 12/1963 | Joesting | 236/13 |
| 3,390,720 | 7/1968 | Meckler | 236/13 |
| 3,395,633 | 8/1968 | Warren, Jr. et al. | 236/13 |
| 3,417,577 | 12/1968 | Waldron | 62/411 |
| 3,611,908 | 10/1971 | Spoormaker | 98/38 E |
| 3,744,715 | 7/1973 | Maddocks | 236/13 |
| 3,823,870 | 7/1974 | Chandler | 98/38 |
| 3,883,071 | 5/1975 | Meckler | 236/13 |

*Primary Examiner*—Lloyd L. King
*Attorney, Agent, or Firm*—John C. Purdue

[57] ABSTRACT

Air conditioning apparatus is disclosed. The apparatus is a terminal of the mixing type, receiving primary conditioned air, and delivering that air or a mixture including that air and recirculated air as required, for air conditioning. The rate at which primary conditioned air is delivered to the zone is varied between a maximum and a predetermined lesser rate as the air conditioning load on the space varies between a maximum and an intermediate load. The apparatus also includes a blower, nozzle or the like for inducing a flow of air from outside, and for mixing the induced air with primary conditioned air, so that such mixture is delivered to the zone. According to preferred embodiments which are disclosed, the apparatus is effective to deliver to the zone such a mixture of primary conditioned air and induced air under all conditions of air conditioning load on the zone. One disclosed mixing unit induces a flow of air from a closed zone surrounding the induction portion, and provides temperature control by admitting primary air, room air, heated air or mixtures, as required, to the closed zone.

2 Claims, 21 Drawing Figures

AIR CONDITIONING APPARATUS

This is a continuation, of application Ser. No. 572,792 filed Apr. 29, 1975, now abandonded.

BACKGROUND OF THE INVENTION

The load in any given zone of an air conditioned building can vary substantially from time to time depending upon such factors as the occupancy of that zone at a given time, the load imposed by lights, computers, and other equipment that may be used within the zone, and the solar load that may be imposed upon the zone by solar energy transmitted thereinto through walls, roof, window openings, etc. Accordingly, an effective air conditioning system must include some control means to enable the maintenance of a temperature within a desired range notwithstanding variations in the air conditioning load which occur from time to time for the indicated and other reasons. Numerous mixing boxes* of the induction type have been suggested. For example, the rate at which primary conditioned air is delivered to the mixing box can be varied, with a compensating variation in the rate at which a flow of air, for example from a plenum, is induced into the mixing box for mixture with the primary air, so that a mixture flows from the box at a substantially constant rate, but the temperature varies depending upon the proportions of primary conditioned air and induced air in the mixture. A mixing box has also been suggested where the flow of primary air induces a flow of warm air from a plenum, a flow of neutral air from the space, or a mixture of plenum air and room air, depending upon the positions of thermostatically controlled dampers. It has further been suggested that primary conditioned air can be by-passed around the induction portion of a mixing box to provide a maximum flow of primary conditioned air, with no induction for times of peak load on an air conditioning system.

* See, for example, U.S. Pat. Nos. 3,390,720; 3,516,606; 3,583,477; 3,604,625; 3,610,522; 3,611,908; and 3,883,071.

U.S. Pat. No. 3,883,071 discloses and claims apparatus which can be mixing a box of the induction type or a combined fluidic valve and induction box for zone control of temperature in an air conditioning system. In either case, the apparatus receives primary conditioned air, and delivers that air as required, for air conditioning. A signal is established which varies as a function of the air conditioning load on the zone served by the apparatus, and the rate at which primary conditioned air is delivered to the zone is varied between a maximum and a predetermined lesser rate at which the minimum fresh air required for ventilation is supplied to the space as the air conditioning load on the space varies between a maximum and an intermediate load. The apparatus includes an induction nozzle for inducing a flow of air from outside, for mixing with primary conditioned air, so that such mixture is delivered to the zone.

When the air conditioning load on the zone is below the intermediate load, the induced flow from outside includes heated air, as required, for temperature control. Preferably, when the air conditioning load is below the intermediate load, the induced flow from outside is at a constant rate, and is heated air, e.g., from a plenum, or a mixture of heated air and neutral air from the zone.

The instant invention is based upon the discovery of improved apparatus for zone control of temperature in an air conditioning system. The apparatus, in some embodiments, is similar in function to the mixing box of U.S. Pat. No. 3,883,071, except that a fan rather than an induction nozzle is used to induce a flow of air; different means for controlling the flow of conditioned and recirculated air are also provided in some embodiments while, in still others, conventional and modified air bars are used in combination with other apparatus to accomplish the desired control. Apparatus is also provided wherein the rate at which primary conditioned air which includes air for ventilation, is delivered to the zone is varied between a maximum and a predetermined lesser rate as the air conditioning load on the space varies between a maximum and an intermediate load, and wherein, when the air conditioning load on the zone is below the intermediate load, primary conditioned air continues to be delivered at the predetermined lesser rate while an induced flow from outside includes heated air, as required, for temperature control, but wherein the necessity for establishing a signal which varies as a function of the air conditioning load is eliminated. The predetermined lesser rate at which primary air is delivered to the space under the stated conditions is one at which the minimum fresh air required for ventilation is supplied to the space by the primary conditioned air.

DETAILED DESCRIPTION OF THE INVENTION

Figure 1:
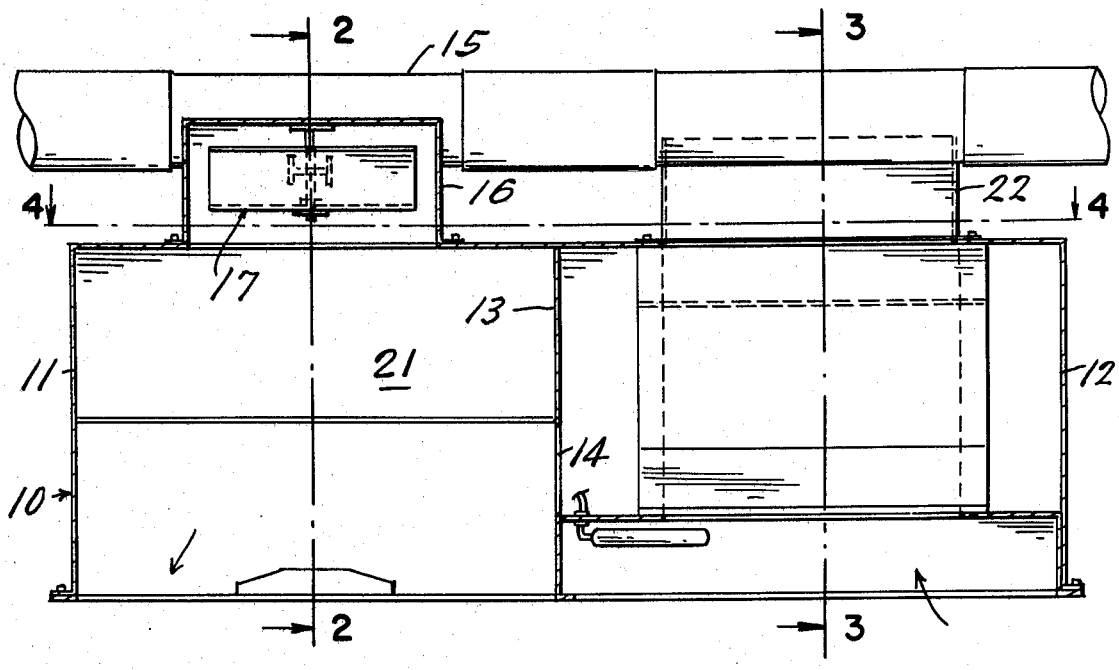
FIG. 1 is a partially sectioned elevational view of an induction unit according to the invention.

Referring to FIG. 1, an induction unit is indicated generally at 10. The unit 10 is made up of a pair of side by side components, 11 and 12, which are separated from one another by a baffle 13. Air flow between the components 11 and 12 can occur, as subsequently explained in more detail, through an opening 14.

Figure 2:
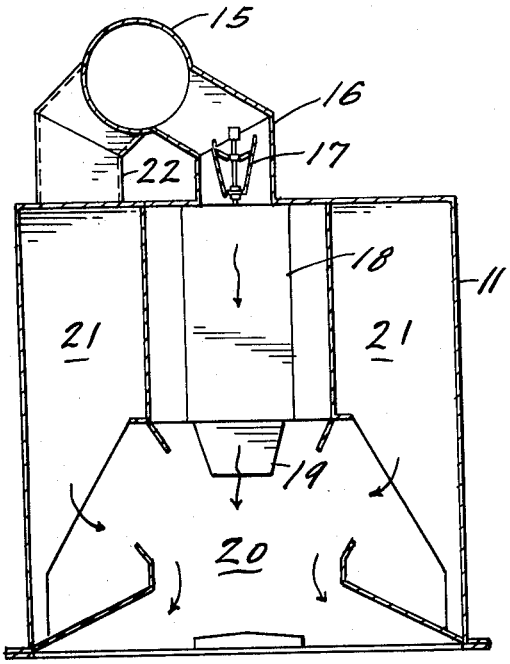
FIG. 2 is a sectional view taken along the line 2—2 of FIG. 1, showing a component of the induction unit of FIG. 1.

Referring to FIG. 2, the component 11 receives primary conditioned air from a duct 15 through an inlet 16, and at a substantially constant flow rate under the control of a constant volume valve 17. Conditioned air flows from the inlet 16 through a passage 18, a restricting orifice 19 into a chamber 20, and from thence out of the component 11 into a space to be air conditioned. The flow of conditioned air, as just described, induces a flow of air into the chamber 20 from regions 21 which are outside the passage 18, but inside the component 11. As subsequently explained in more detail, the temperature of the air in the regions 21 is varied, as required, to maintain a predetermined temperature in a space to be air conditioned.

Figure 3:
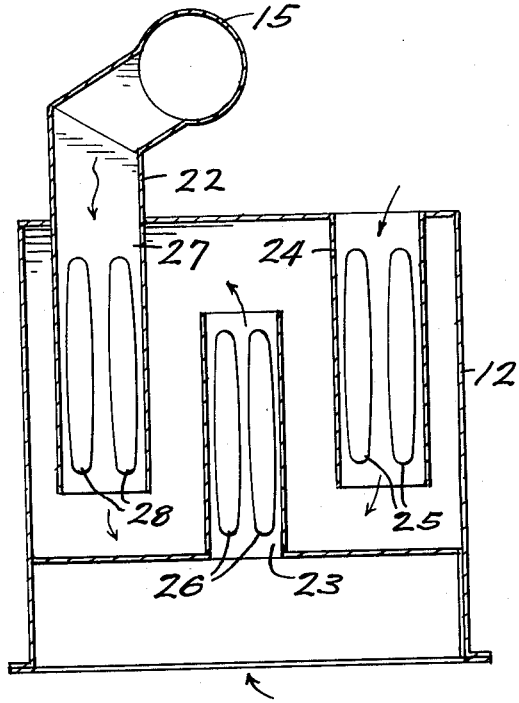
FIG. 3 is a sectional view taken along the line 3—3 of FIG. 1, showing another component of the induction unit of FIG. 1.

Referring, now, to FIG. 3, the component 12 can receive conditioned air from the duct 15 through an inlet 22. The component 12 can also receive recirculated air from the space being air conditioned; such air can flow upwardly as indicated by an arrow, from the space and into a passage 23. Finally, the component 12 can receive heated air from a plenum thereabove or from a heated air duct (not illustrated); such air enters the component 12, as indicated by an arrow, flowing through a passage 24.

The flow of heated air in the passage 24 is controlled by pneumatic valves* 25 positioned therein. The flow of recirculated air from the space in the passage 23 is controlled by pneumatic valves 26 positioned therein, while the flow of conditioned air from the inlet 22 through a passage 27 is controlled by pneumatic valves 28 positioned therein. Air which flows into the interior of the component 12 through any one of the passages 23, 24 and 27 is discharged, in normal operation of the induction unit, only through the opening 14 (FIG. 1) from whence it enters the regions 21 (FIG. 2), and is the air which is induced to flow into the chamber 20 by the flow of conditioned air through the restricting orifice 19.

* The specific valves shown are commercially available from Connor Engineering Corp. under the designation "Pneumavalve."

Referring again to FIG. 3, the temperature of the air within the component 12 is controlled by the pneumatic valves 25, 26 and 28. For example, under conditions of "heavy" load in the space to be conditioned, the valves 25 and 26 are closed and the valves 28 are open, so that all of the air supplied to the space is conditioned air. When the load decreases from the "heavy" condition the valves 28 and 26 are modulated in opposition to maintain a desired control temperature. The limiting condition on this mode of operation is reached when the valves 28 are closed and the valves 26 are fully opened. The constant volume valve 17 (FIG. 1) is set so that the flow of conditioned air through the passage 18 provides the minimum fresh air required for ventilation. It will be appreciated that, as the valves 26 and 28 are modulated in opposition, the effect of this modulation is to keep the rate at which air is delivered to the space constant, but to vary the proportions of recirculated room air and of conditioned air. It follows that when the valves 28 are closed and the valves 26 are fully opened, conditioned air is being delivered to the space at the minimum rate required for ventilation. Accordingly, as the air conditioning load decreases further, reheating is necessary. This is accomplished by modulating the valves 25 and 26 in opposition until the valves 26 reach a closed position and the valves 25 are fully opened (minimum air conditioning load on the space). It will be appreciated that the valves 25 remain closed, except when they are being modulated in opposition with the valves 26, and that the valves 28 remain closed except when they are being modulated in opposition with the valves 26.

The induction box 10 provides effective control over the temperature of the space being air conditioned notwithstanding wide variations in the air conditioning load. For example, the flow of conditioned air through the restricting orifice 19 (FIG. 1) can be at a rate of 0.2 cubic feet per minute per square foot of floor space, and can induce a flow of air from the region 21 at a rate of 0.4 cubic feet per minute per square foot of floor space. If the conditioned air flowing through the orifice 19 is at a temperature of 50° F., and plenum air is available at 85° F., it can be demonstrated that the induction unit 10 is capable of delivering air at a rate of 0.6 cubic feet per minute per square foot of floor space, and at a temperature varying from 50° F. to 73° F.

Figure 4:
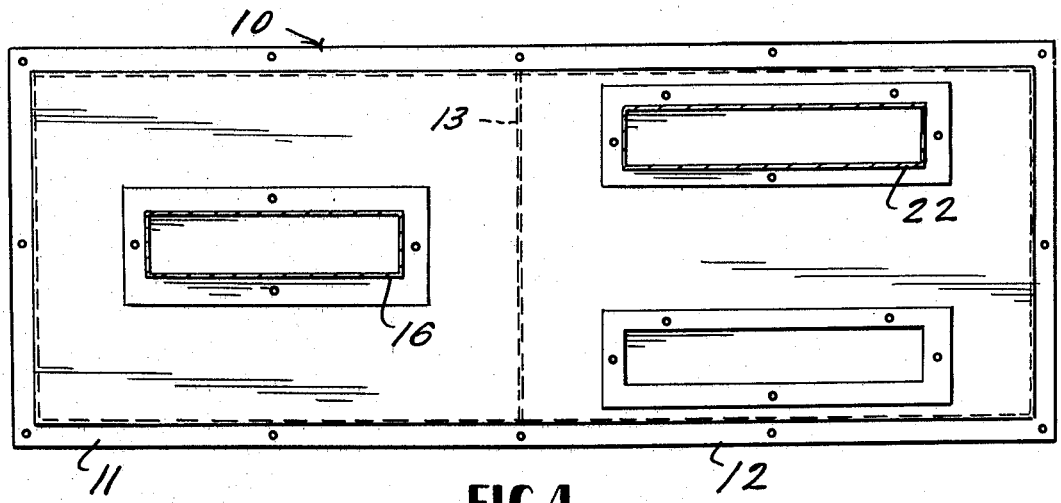
FIG. 4 is a sectioned plan view of the induction unit of FIG. 1, taken along the line 4—4 of FIG. 1.

Further details of the construction of the specific induction unit 10 are shown in FIG. 4.

Figure 5:
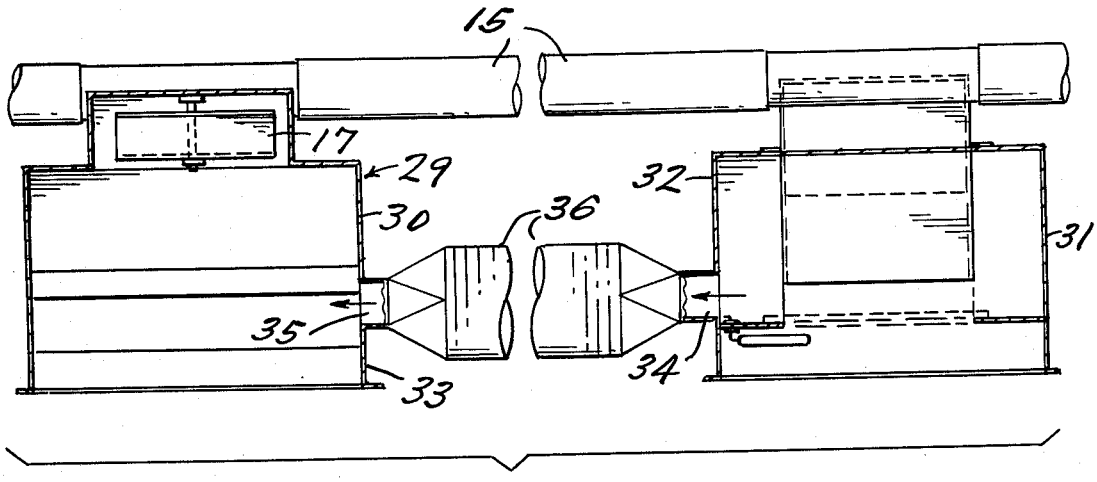
FIG. 5 is a view in vertical elevation showing an induction unit similar to that shown in FIG. 1.

Referring to FIG. 5, another embodiment of an induction unit is indicated generally at 29. The unit 29 is made up of a pair of components 30 and 31, which are substantially identical with the components 11 and 12. (FIGS. 1-3) of the unit 10. Instead of being side by side and separated by a baffle 13, however, the units 30 and 31 (FIG. 4) are physically separated and have closed ends 32 and 33 with openings 34 and 35 to enable, in cooperation with an associated flexible component 36, a flow of air from the component 31 to the component 30 for induction by and mixture with conditioned air delivered to the space to be conditioned, as previously set forth in connection with the description of the operation of the components 11 and 12.

Figure 6:
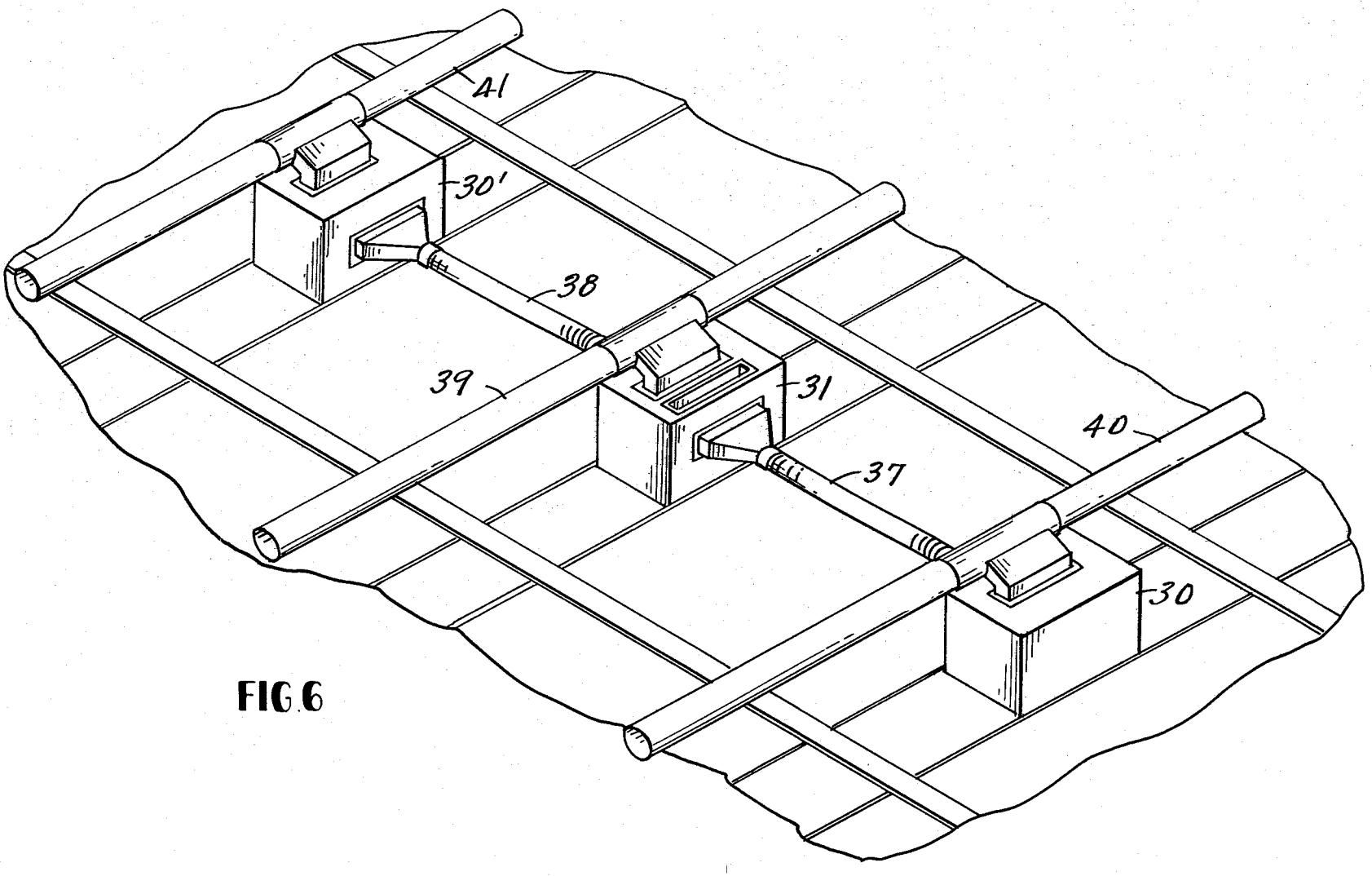
FIG. 6 is a perspective view showing a ceiling structure incorporating a plurality of induction units similar to those of FIG. 5.

As shown in FIG. 6, one of the components 31 can be operatively associated through flexible components 37 and 38 to each of two components 30 and 30', respectively. This arrangement has certain advantages. As shown in FIG. 6 the component 31 receives primary conditioned air, as required, from a duct 39, while the components 30 and 30' receive primary conditioned air from ducts 40 and 41. In an installation serving a floor or a portion of a floor of a building comprising, in either case, a plurality of zones, the air conditioning load on any given zone will ultimately vary from time to time. Such variations in load often necessitate, as previously explained, a change in the rate at which conditioned air is delivered to that particular zone. However, the rate at which non-induced conditioned air is delivered to the space by the units 30 and 30' remains constant, regardless of variations in load. Variations in rate at which total conditioned air is delivered to the space to accommodate changes in load involve only the components 31, several of which are connected to the duct 39. Thus, pressure in the duct 39 is subject to variations under changes in load. Since the components 30 and 30' receive conditioned air from the ducts 40 and 41, respectively, rather than from the duct 39 (all of the ducts normally being connected to an upstream trunk duct), variations at which conditioned air is delivered to the space to accommodate variations in load have only a minimal effect on the flow of non-induced conditioned air through the components 30 and 30'. These minimal effects can be substantially eliminated, and a system that is more nearly completely balanced can be provided merely by providing a static pressure sensor (not illustrated) at the upstream end of the duct 39 and controlling a pneumatic valve (not illustrated) at the downstream end of the duct 39 to maintain a constant pressure at the sensor. Even greater balance can be provided by using a constant volume valve (not illustrated) at the upstream end of each of the ducts 40 and 41.

As a practical matter, a certain minimum circulation must be provided in a building zone for comfort of the occupants. This requirement is in addition to minimum ventilation (fresh air) requirements. The air conditioning system must also be capable of accommodating varying zone air conditioning load conditions within a certain range, as discussed above. In a zone utilizing the apparatus of FIGS. 1 through 6 (and also FIGS. 7 and 8, discussed below), it may well occur that a sufficient number of components provided for accommodating load variations will not be sufficient to provide a minimum air movement required for proper circulation. Therefore, a sufficient number of auxiliary room air intake units (not shown) may be provided and operably connected to the inducing components to draw additional room air into mixture with the conditioned air flow. The auxiliary air intake units would not be controlled, but would remain open, thereby providing for a quantity of auxiliary room air induction under all load conditions. The provision of the auxiliary units represents a compromise: the ability of the system to meet changing loads is lessened, but the number of components of the types described above in reference to FIGS. 1 through 6 is reduced, thereby saving equipment cost. The number of such components and of the auxiliary units should be proportioned so that the system can meet the required load variations and also meet circulation requirements without providing more of the valve-controlled components (such as the component 12 of FIG. 3) than necessary.

The above air conditioning apparatus described in connection with FIGS. 1 through 6 can also be utilized in connection with a cellular concrete floor structure (not illustrated) such as those shown and described in U.S. Pat. No. 3,148,727. In such a system, several of the linearly-extending "cells" within the concrete floor would be appropriately connected as conditioned air ducts. Induction air supply components such as the components 11 or 30 of FIGS. 1–6, positioned in the ceiling below, could be connected to one such conditioned air duct, preferably by flexible connectors. Control components in the ceiling, such as the components 12 or 31 of FIGS. 1–6, could be connected to the same or a separate conditioned air duct. For separated components such as the components 30 and 31, a flexible connector would extend between them as described above (see, e.g., FIG. 6). It will be appreciated that such an air conditioning system will function and can be controlled in the same manner as that described in reference to FIGS. 1–6.

Figure 7:
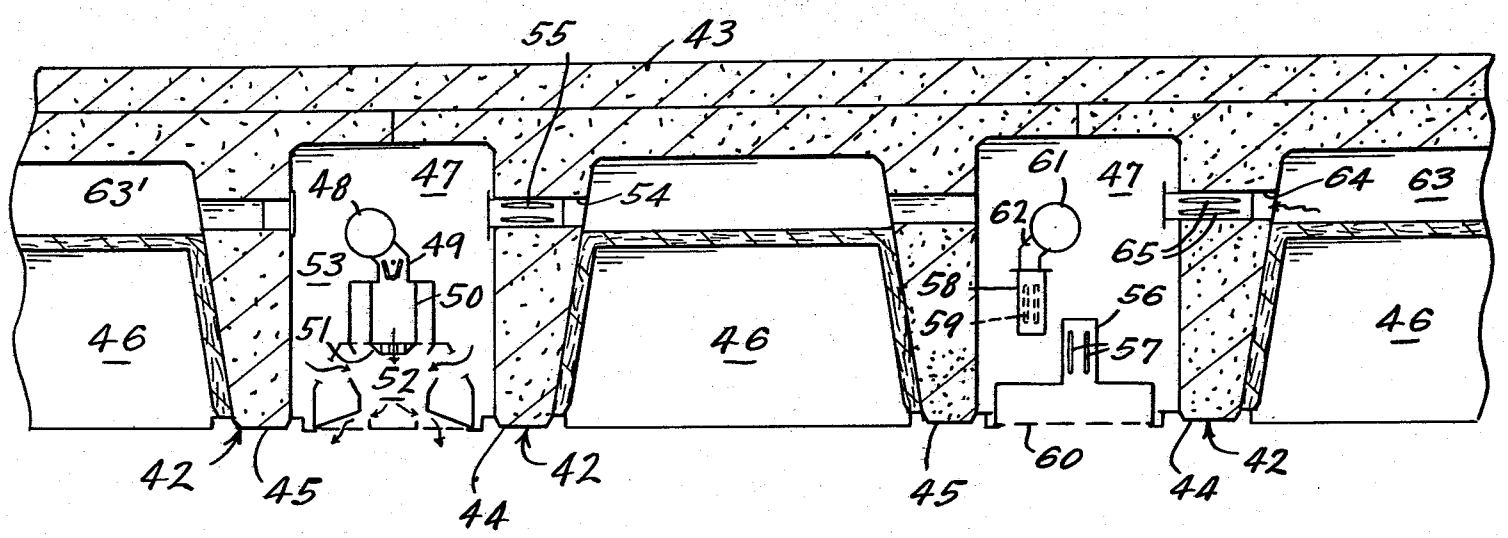
FIG. 7 is a view in vertical elevation showing another ceiling structure employing an induction unit similar to the units of FIGS. 1 and 5.

An induction unit which is functionally equivalent to the units illustrated in FIGS. 1 through 6 and described in connection therewith as shown in FIG. 7 as a part of a concrete floor-ceiling structure. The structure is shown as involving double T beams 42 supported on girders (not illustrated) and, in turn, supporting a poured concrete floor 43. The beams 42 and associated structure constitute a ceiling for the floor below, while the beams support the floor 43 above, as indicated. The beams have left and right legs 44 and 45, respectively, and longitudinally extending channels 46 therebetween. Longitudinally extending channels 47 are also formed between the legs 45 and 44 of adjacent ones of the beams 42. Primary conditioned air is delivered to a space below the beams 42 from a duct 48. The conditioned air flows through an inlet 49, a passage 50, restricting orifices 51 and a chamber 52, and from thence to the space. Flow of conditioned air through the nozzles 51 induces a flow of air from regions 53 into the chamber 52 shown by arrows. This induction causes, in turn, a flow of air through a passage 54, which flow can, if desired, be controlled by pneumatic valves 55. This flow may be drawn through passages 56 and/or 58 under the control of pneumatic valves 57 and 59, respectively. Air flowing through the passage 56 is recirculated space air which flows through a perforated plate 60 and into the passage 56. Air flowing through the passage 58 is primary conditioned air from a duct 61 which flows to the passage 58 through an inlet 62.

By suitable control of the valves 57 and 59, and leaving the valves 55 in a fully open position, the apparatus of FIG. 7 can be operated to deliver, say, 0.6 cubic feet per minute per square foot of floor area of primary conditioned air or of a mixture of primary conditioned air with recirculated air in any proportion up to two volumes of recirculated air per volume of primary air. This variation is accomplished in the manner previously described with reference to FIGS. 1 through 4 of the drawings. The apparatus can also be operated so that heated air is supplied to the regions 53 for mixture with conditioned air in the chamber 52 and delivery to the space. This can be accomplished by providing heated air in a chamber 63 from a heated air duct (not illustrated), for example by circulating air from the space through a lighting fixture (not illustrated) and into the chamber 63, by means of a reheat coil (not illustrated), by utilizing solar heat at windows, or in any other suitable manner. This heated air flows through a passage 64, as required, under the control of pneumatic valves 65, and is used either alone or in a mixture with room air circulated through the passage 56, as required under conditions of low air conditioning load. A chamber 63' shown to the left in FIG. 7 may be used alternatively or in addition to the chamber 63 for receipt of heated air, with the inclusion of appropriate pneumatic valves (not illustrated).

Separation, longitudinally, of the beams 42 between adjacent zones of the building, vis-a-vis air conditioning, can be accomplished by vertically extending panels in the channels 47.

Still another embodiment of an induction unit according to the invention is indicated generally at 66 in FIG.

8. The induction unit 66 comprises an inductor 67 and components 68 and 69 which are functionally equivalent to the component 12 of FIG. 3 and the component 31 of FIGS. 5 and 6.

Referring again to FIG. 8, the inductor 67 is composed of a channel 70 having vertically extending sidewalls 71 and a web 72 having a plurality of transverse vanes 73 each of which is rotatable about its longitudinal axis to control air flow. In operation, primary conditioned air flows from a duct 74 through a restriction 75 into the interior chamber of the channel and from thence between the web 72 and the transverse vanes 73 and into the space to be conditioned, as indicated by the arrows. Flow of the primary conditioned air through the restriction 75 induces a flow of air into the interior chamber of the channel 70 through openings 76, one of which can be seen in FIG. 8, and the induced air is mixed with the conditioned air and delivered to the space. Induced air flows to the openings 76 from the components 68 and 69 through flexible connectors 77 and 78.

As indicated, the components 68 and 69 are functionally equivalent to the component 12 of FIG. 3 or the component 31 of FIGS. 5 and 6. The components 68 and 69 can indeed be identical to the component 12 (apart from obvious modifications necessary to adapt them for use in the induction unit 66) utilizing a separate primary conditioned air duct (not shown) similar to the duct 15 (see FIG. 3) for each component 68 and 69. However, in the embodiment shown in FIG. 8, the components 68 and 69 receive conditioned air, when required, from the duct 74 through flexible connectors 79 and 80. The unit 66 accomplishes zone temperature control by drawing conditioned air from the duct 74, space air (or mixtures of the two), heated air or mixtures of space air and heated air through passages (not illustrated in FIG. 8) under the control of pneumatic valves (not illustrated in FIG. 8).

Separating adjacent air conditioning zones in the induction unit 66 requires merely a baffle extending vertically upwardly from the web 72 of the channel 70, and at least as high as the restriction 75, but not sufficiently high to interfere with the flow of conditioned air in the duct 74.

Figure 8:
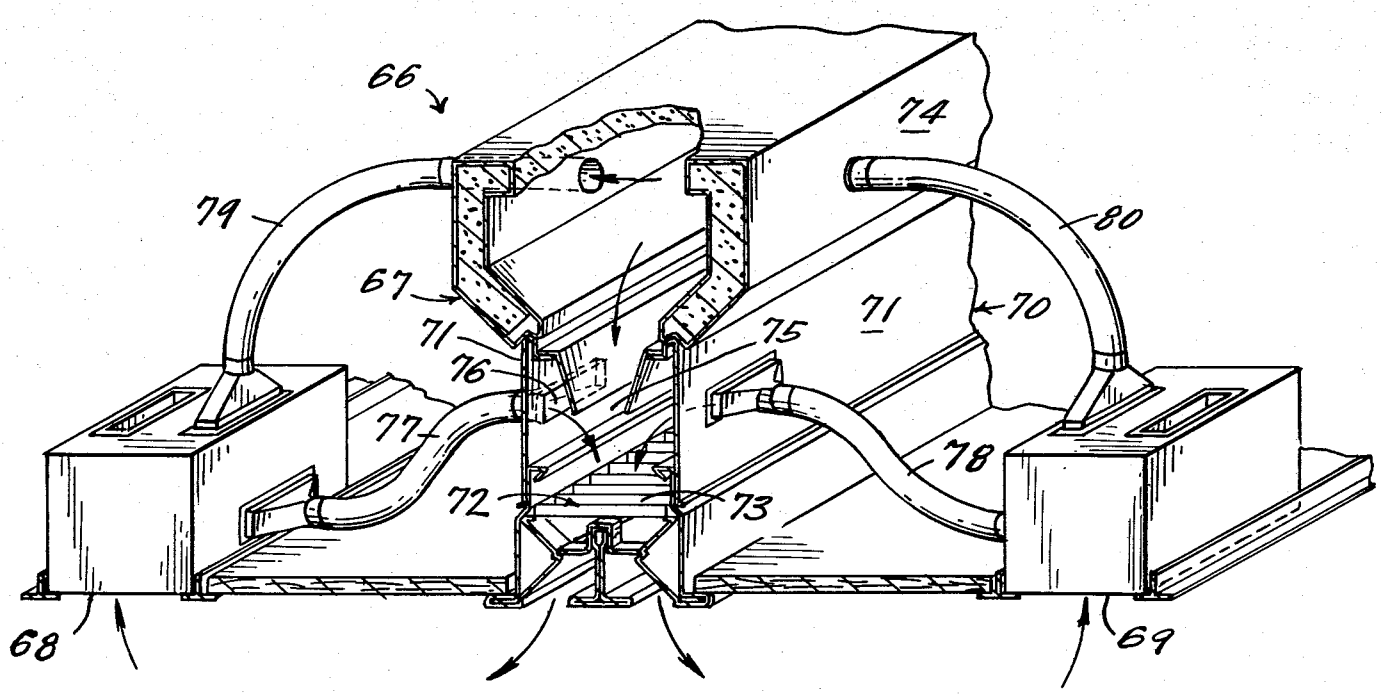
FIG. 8 is a view in perspective showing still another embodiment of an induction unit similar to the units of views 1, 5 and 7.
Figure 9:
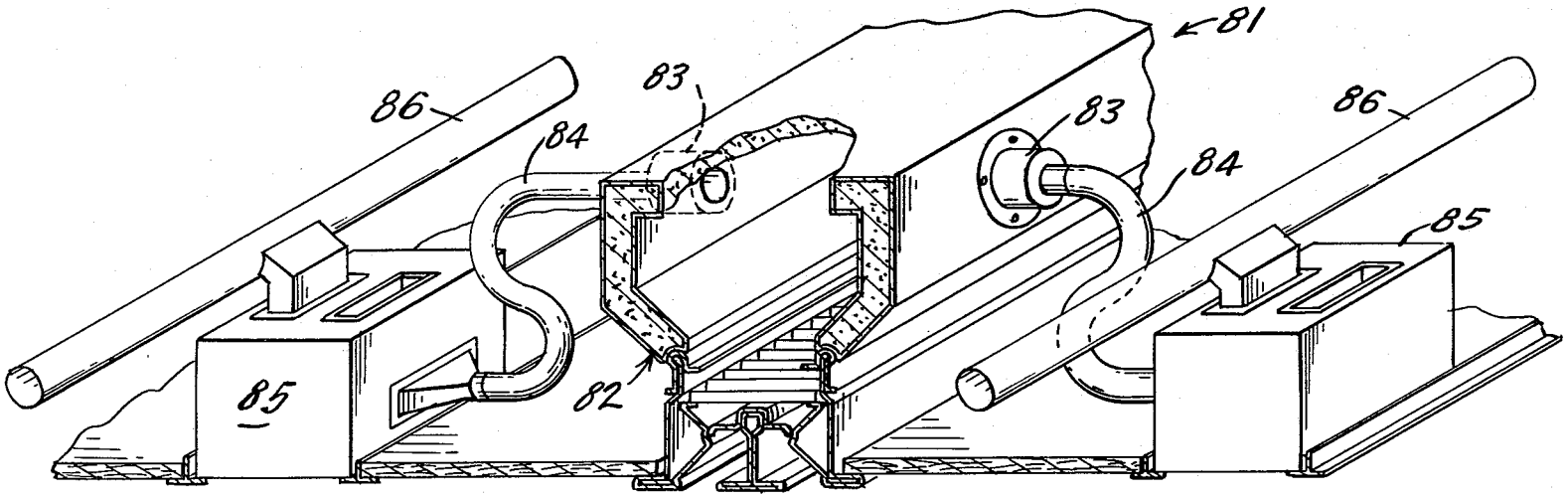
FIG. 9 is a view in perspective showing an air conditioning terminal and control components utilizing blowers rather than induction.

Referring now to FIG. 9, a further embodiment of the invention is illustrated and generally identified as 81. The unit 81 includes an air delivery component 82 which is similar to the inductor 67 of FIG. 8, but which has no restriction and does not induce air or act as a conditioned air supply duct. Instead, all air entering the air delivery component 82 for delivery to the space is supplied via fans 83. The fans draw air, through flexible connectors 84, from control components 85 similar to the components 68 and 69 of FIG. 8 and the components 12 and 31 of FIGS. 3, 5 and 6. Primary conditioned air ducts 86 supply the control components with conditioned air, the ducts 86 being the only source of conditioned air for delivery to the space.

For zone ventilation, circulation and temperature control, the components 85 supply the delivery component 82 with conditioned air from the ducts 86, along with space air, heated air (e.g. plenum air), or mixtures of space air and heated air through passages (not illustrated in FIG. 9) under the control of pneumatic valves (not illustrated in FIG. 9). For example, assume it is desirable to deliver 0.6 cubic feet per minute per square foot of floor space of total air into the zone, with a minimum of 0.1 cubic feet per minute per square foot of floor space of conditioned air required for ventilation. The fans 83 are effective to deliver the appropriate amount of air so that 0.6 cubic feet per minute per square foot of floor space is supplied to the zone. The pneumatic valves may be regulated to supply conditioned air, room air and heated air in, for example, the following ranges: conditioned air, 0.1–0.5 CFM; room air, 0–0.5 CFM; and heated air, 0–0.5 CFM. Thus, under maximum air conditioning load, 0.3 CFM conditioned air mixed with 0.3 CFM room air would be delivered to the zone; at intermediate load, 0.1 CFM conditioned air mixed with 0.5 CFM room air would be delivered; and at minimum load, 0.1 CFM conditioned air mixed with 0.5 CFM heated air would be delivered. For loads between maximum and intermediate and between intermediate and minimum, the pneumatic valves can be modulated to provide varying quantities of conditioned air and room air, and of conditioned air, room air and heated air, respectively, the total air always being 0.6 CFM. Of course, for loads from intermediate to minimum, conditioned air remains at 0.1 CFM. (The minimum ventilation air requirement).

The apparatus of FIG. 9, which utilizes air-supplying fans rather than induction, actually reduces the total energy required for moving air in the system, in spite of the energy required for driving the fans 83. This is due in part to the fact that none of the air flowing to the space need flow through a restriction, and in part to the smaller size of conditioned air-supplying units needed upstream in the system.

Figure 10:
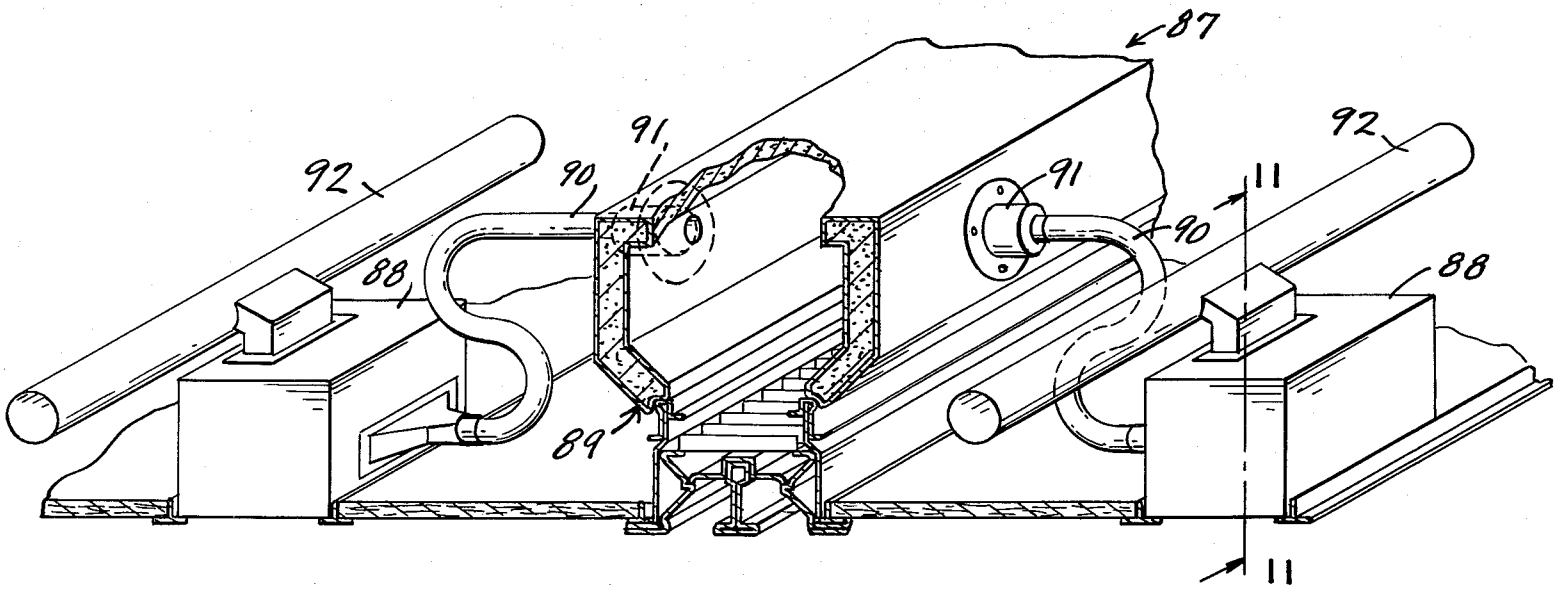
FIG. 10 is a view in perspective showing another embodiment of an air conditioning apparatus similar to the unit of FIG. 9.

Referring now to FIG. 10, another embodiment of the invention is illustrated. The unit shown, generally identified as 87, is similar to the unit 81 of FIG. 9, but without provision in its control components 88 shown on FIG. 11 for delivery of plenum or other heated air to the air delivery component 89. The unit 87 includes flexible lines 90 connecting the components 88 with the air delivery component 89, with the provision of fans 91 for moving air from the components 88 to the component 89. Primary conditioned air is supplied through conditioned air ducts 92 connected to each of the control components 88.

Figure 11:
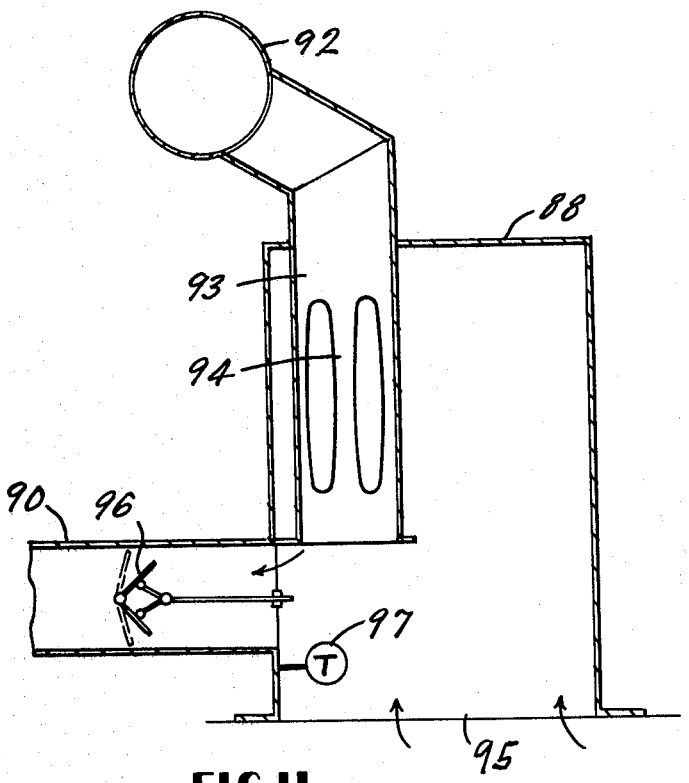
FIG. 11 is a sectional view taken along the line 11—11 of FIG. 10 showing a component of the apparatus of FIG. 10.

As seen in FIG. 11, the conditioned air duct 92 communicates with the interior of the component 88 through a passageway 93 controlled by a pneumatic valve 94. The lower side of the component 88 is open and defines a room air inlet 95. A constant volume of conditioned air and/or room air is delivered through a flexible line 90 from each component 88 to the air delivery component 89 by the fan 91 and a constant volume valve 96 positioned between the component 88 and the component 89. Thus, the relative proportions of conditioned air and room air passing through the flexible line 90 to the component 89 are controllable via the pneumatic valve 94 alone. With the pneumatic valve 94 wide open, a maximum amount of conditioned air will be delivered to the space, with a minimum amount of room air mixed therewith. Of course, if a resistance (not illustrated) is included in the room air inlet 95, flow of room air can be reduced virtually to zero when the pneumatic valve 94 is in the wide open position. When the pneumatic valve 94 is in a fully closed position, the flow of air to the space will be entirely recirculated space air, providing circulation required for comfort in the zone without heating or cooling. If a minimum flow of conditioned air is required for ventilation, control for the pneumatic valve 94 can be set so that conditioned air does not go below the minimum flow. Control for the pneumatic valve 94 can be provided, through conventional equipment, by a thermostat 97 positioned in the path of room air flow, since there is always some air flowing through the inlet 95. Significantly, the embodiment shown in FIGS. 10 and 11 provides variably proportioned zone control air flow with the use of only one variable volume air valve.

It should be appreciated that for a system including reheat of conditioned air, or for a system capable of both heating and cooling a space, an additional valved opening (not illustrated) can be provided for admitting plenum or otherwise heated air into the component. Such a component would be similar to the component 12 of FIG. 3 or the component 85 of FIG. 9, except that the room air inlet would be constantly open, without valving, and a constant volume valve such as the valve 96 of FIG. 11 would be provided between the control component and the air delivery component. With the inflows of conditioned air and heated air both regulable, no valve control is needed for room air. For example, at maximum air conditioning load the conditioned air valve would be wide open with the heated air valve fully closed, while at minimum air conditioning load, the conditioned air valve would be open only as required for minimum ventilation with the heated air valve fully open (no conditioned air would be required if fresh heated air is supplied). At intermediate loading, the conditioned air valve would be open as required for minimum ventilation, with the remainder of the air flow being supplied by space air through the room air inlets. For air conditioning loads ranging between maximum and intermediate and minimum, variable proportions of conditioned air and room air and of room air and heated air would be provided, respectively, by control of the conditioned air valve and of the heated air valve.

Figure 12:
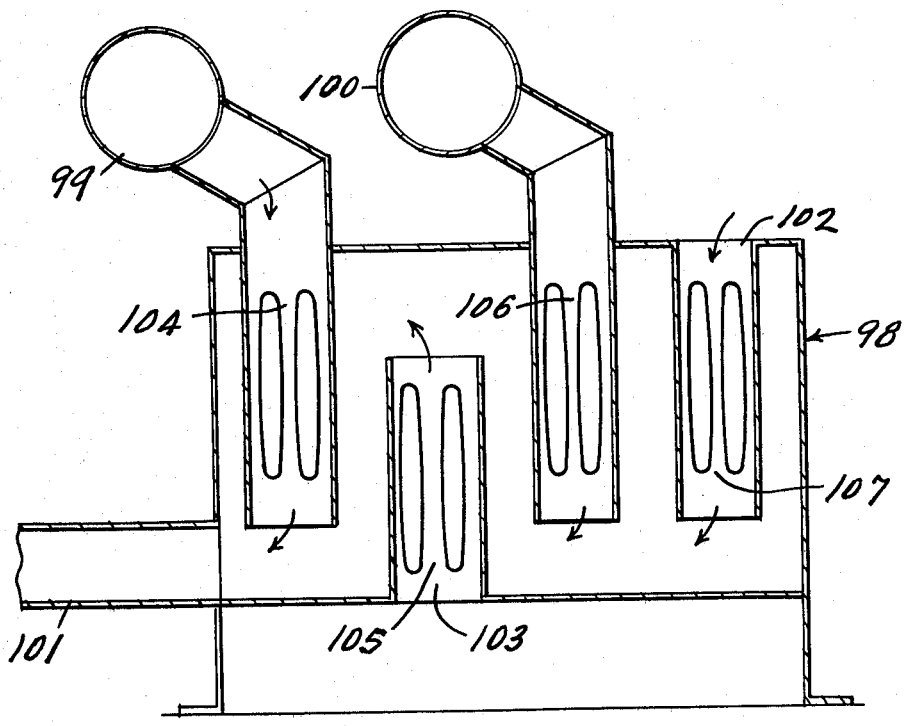
FIG. 12 is a sectional view of a control component for serving a conditioned air delivery component similar to that of the apparatus of FIG. 10.

FIG. 12 shows another embodiment of a control component 98 for serving a conditioned air delivery component such as the component 89 of FIG. 10. The component 98 is connected to a primary conditioned air duct 99, to a hot air duct 100 and to an air delivery duct 101 which is connected to an air delivery component such as the component 89 of FIG. 10, including a fan between the component 98 and the air delivery component (not illustrated). The component 98 also has passageways 102 and 103 for the inflow of plenum air and room air, respectively. Pneumatic valves 104, 105, 106 and 107 control the flow of conditioned air, room air, ducted hot air and plenum air, respectively, into the component 98. The component 98 is capable of a full range of zone cooling and heating control. It may be operated with or without reheat of conditioned air by plenum air during the air conditioning mode, as described in connection with several of the above embodiments. The ducted hot air would of course never be used for reheat of conditioned air.

In a preferred mode of operation of the control component 98, no more than two of the air valves 104 through 107 are opened at one time. The temperatures of the air entering the component 98 may be, for example, about 50° F for conditioned air, 75° F for room air, 85° F for plenum air and 110° F for ducted hot air. Under temperature load conditions varying from maximum cooling requirements to a first intermediate level, the conditioned air and room air valves 104 and 105 may be modulated to provide a range from all conditioned air, through mixtures of conditioned and room air, to all room air. Of course, the conditioned air valve 104 may be maintained open to a small degree under these conditions to satisfy a minimum zone ventilation requirement.

For temperature loading conditions between the first intermediate level and a second intermediate level, the room air and plenum air valves 105 and 107 may be modulated to provide an air supply varying from all room air, through mixtures of room air and plenum air, to all plenum air. Again, a minimum flow of conditioned air may be maintained under this condition to meet zone ventilation requirements.

For zone temperature load conditions varying from the second intermediate level to maximum heating requirements, the plenum air and ducted hot air valves 107 and 106 can be modulated. The air thus delivered to this zone via the component 98 would vary from all plenum air, through mixtures of plenum and hot air, to all hot air. For minimum ventilation requirements under this condition, the ducted hot air valve 106 can be maintained open to a slight degree, even under minimum heating conditions in this range. Under such minimum conditions, when all plenum air would normally supply air at the correct temperature for heating the zone, the room air valve 105 can be opened as required to balance the quantity of ducted hot air admitted for ventilation.

It will be appreciated that a system including the control component 98 meets a full range of heating, ventilating and air conditioning requirements for a zone. With the use of conventional thermostat-operated control equipment, the multiple zones of a building can be individually temperature-controlled efficiently and economically, with cold air and hot air supplied from central sources and drawn into the various zones as required.

Figure 13:
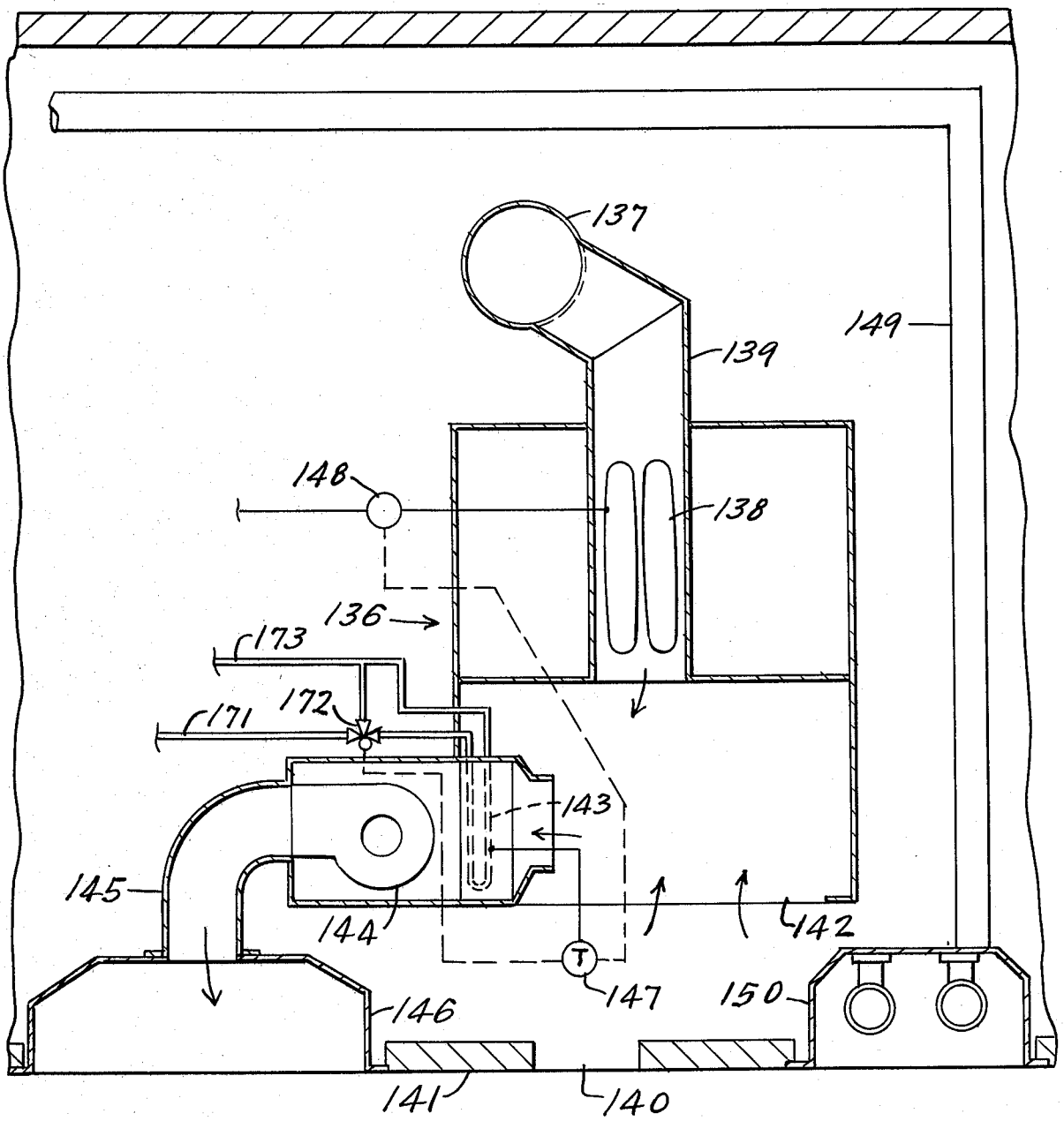
FIG. 13 is a sectional view of still another air conditioning apparatus.

Referring, now, to FIG. 13, air conditioning apparatus indicated generally at 136 is designed expressly for air conditioning a perimeter zone of a building, as distinguished from an interior zone thereof. The apparatus 136 receives primary conditioned air from a duct 137, and at a rate which is controlled by a pneumatic valve 138 in a connector 139. Primary conditioned air which enters the apparatus 136 mixes with recirculated space air which enters the apparatus by flowing through an opening 140 in a ceiling 141 above the space and an opening 142 into the apparatus 136. The opening 140 is appropriately restricted so that the proportions of conditioned air and recirculated space air can be controlled by the valve 138. The resulting mixture flows to the left in FIG. 13, as indicated by an arrow, over a heating coil 143 to the inlet of a blower 144, and is discharged by the blower 144 into a duct 145 through which the mixture flows to a terminal 146 from which it is discharged into the space.

In operation of the apparatus 136, as the air conditioning load varies between a maximum load and an intermediate load (at which the minimum flow of conditioned primary air required for ventilation is just sufficient to offset heat gains) the pneumatic valve 138 is used to control the rate at which primary conditioned air is delivered to the apparatus 136 in order to maintain a control temperature in the space. The pneumatic valve can be controlled by a temperature sensor and controller 147 which senses load, rather than temperature difference, and causes an actuator 148 to control the pneumatic valve 138 as described. The temperature sensor and controller 147 can be, for example, of the type described below in connection with the description of FIG. 14 of the drawings.

The apparatus 136 also includes a return duct 149 through which relief air is removed from the relief space at the same rate at which primary conditioned air enters the space from the terminal 146 as a part of the mixture discharged therefrom to a zone of the building. Relief air from the space reaches the duct 149 by flowing through the interior of a lighting fixture 150 and an opening (not illustrated) in the reflector thereof which communicates with the duct 149. Since the rate at which primary conditioned air is supplied to the apparatus 136 is either the minimum required for ventilation or greater than the minimum by an amount which varies as a direct function of air conditioning load, the rate at which relief air leaves the space through the duct 149 is either the minimum or greater than the minimum by an amount which varies as a direct function of air conditioning load. As a consequence of having relief air leave the space by flowing through the light fixture 150 and of varying the amount thereof as a direct function of air conditioning load, the apparatus 136 varies the proportion of lighting heat that is rejected from the building, whenever the total load is greater than the minimum at which the minimum primary air required for ventilation is at least sufficient to counteract all heat gains, as a direct function of air conditioning load.

The return or relief air discharged from the duct 149, can be part of the return air circulation system to the central air conditioning system or because of its low humidity, can, in part or whole, advantageously be used in conjunction with the regeneration of an aqueous hygroscopic solution from a chemical dehumidifier* (not illustrated), in conjunction with the operation of an evaporative cooler** (not illustrated) or in both.

* See, for example, application Ser. No. 524,255, filed Nov. 15, 1974.
** See, for example, U.S. Pat. No. 3,403,723.

Figure 14:
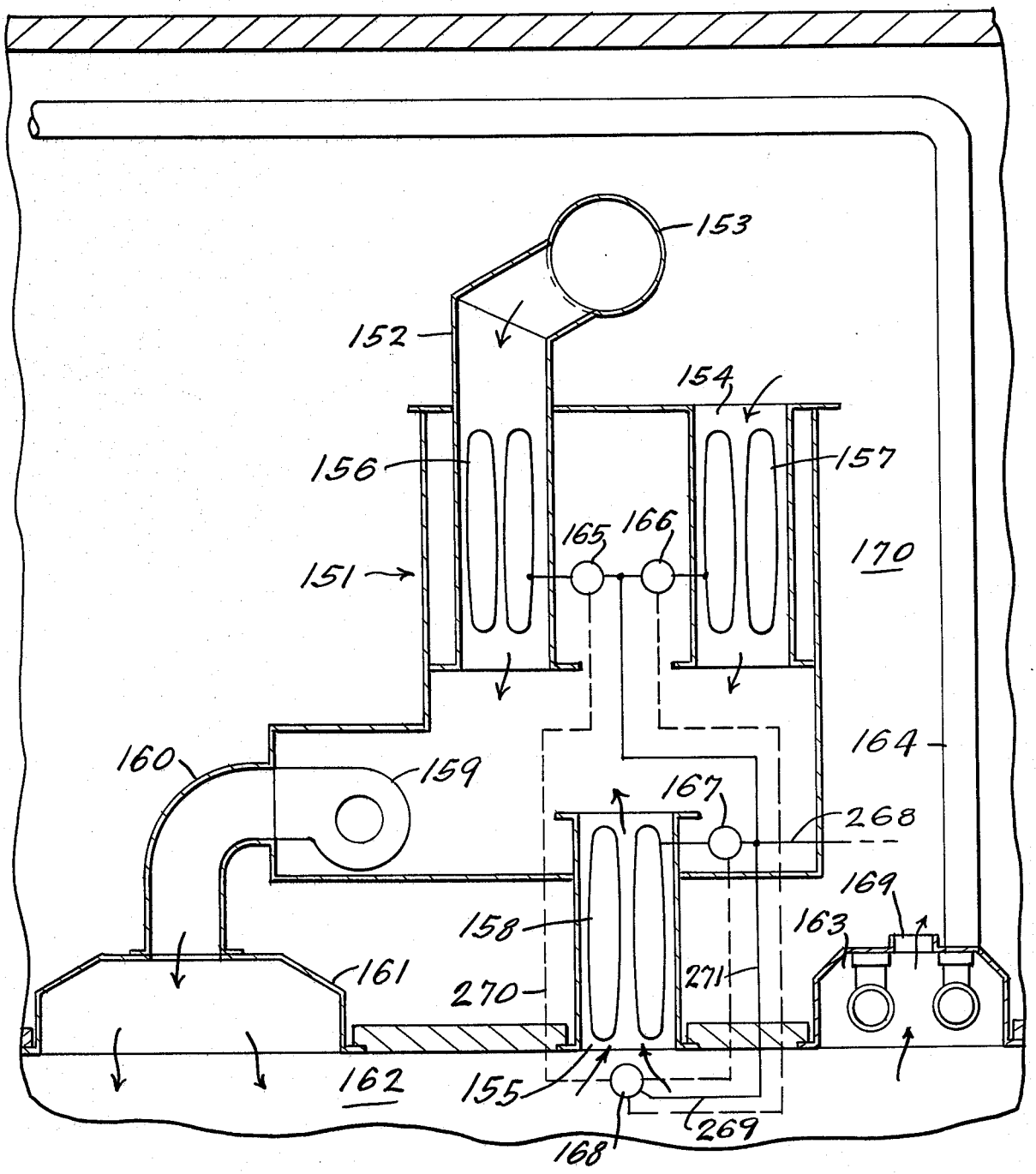
FIG. 14 is a sectional elevational view of yet another air conditioning apparatus, similar to that of FIG. 13.

Referring to FIG. 14, apparatus indicated generally at 151 comprises three inlets, one designated 152 through which primary conditioned air from a duct 153 can enter the apparatus 151, one designated 154 through which plenum air can enter the apparatus 151, and one designated 155 through which recirculated space air can enter the apparatus 151. The flow of conditioned air through the inlet 152, of plenum air through the inlet 154 and of space air through the inlet 155 is controlled by pneumatic valve 156, 157 and 158, respectively.

As is subsequently explained in more detail, a mixture of primary conditioned air with recirculated air from the plenum, recirculated air from the space, or a mixture of the two, enters the apparatus 151. This mixture flows to the left in FIG. 14 to the inlet of a blower 159. The mixture discharged by the blower 159 flows through a duct 160 and a terminal 161 to a zone 162 of a building.

Relief air leaves the zone 162 at the rate that primary conditioned air from the duct 153 enters the zone 162, flowing through a lighting fixture 163 and a duct 164. The apparatus 151 can advantageously be used in interior zones of buildings in which the apparatus 136 (FIG. 13) is used for perimeter zones. In that case, the relief air in the duct 149 and the relief air in the duct 164 can be combined, and used as previously described.

The pneumatic valves 156, 157 and 158 can be controlled by actuators 165, 166 and 167, respectively, under the control of a temperature sensor and controller 168, which generates a signal which varies as a function of air conditioning load. In operation, as the air conditioning load on the space 162 varies from a maximum to an intermediate load at which the minimum flow of primary conditioned air required for ventilation is just sufficient to counteract all heat gains, the pneumatic valve 156 is controlled, as required, to maintain a predetermined temperature. As the load varies within these limits, the pneumatic valve 157 is maintained closed, so that there is no flow of air from the space 162 through an opening 169 in the lighting fixture 163 and into a plenum 170. The pneumatic valve 158 can remain open because the blower 159 will deliver a substantially constant volume of air including all of the primary air admitted by the pneumatic valve 156 and enough air circulated from the space to make up the blower capacity. When the air conditioning load on the space 162 is less than the intermediate load, the pneumatic valve 156 assumes, and remains in, the position which admits to the apparatus 151 the minimum flow of primary conditioned air required for ventilation. Because of the constant delivery of the blower 159 there is considerable flexibility in the manner in which temperature is controlled when the air conditioning load is less than the intermediate load. For example, the pneumatic valve 158 can remain open, while the pneumatic valve 157 is varied between full closed and full open, as required, to control the temperature of the space 162. Whenever the pneumatic valve 157 is open, a flow of air into the apparatus 151 from the plenum 170 is induced (through the opening 154), and a flow of air is induced from the space 162 through the opening 169 of the lighting fixture 163, and into the plenum 170. This air is heated in passing through the fixture 163, so that the air entering the apparatus 151 through the opening 154 provides reheat in an amount which depends upon the amount of air which passes through the opening 154, and the relative proportions of air entering through the openings 154 and 155. When the air conditioning load is sufficiently low that more reheat is required than is provided when the pneumatic valve 157 and 158 are both fully open, still more reheat can be provided by throttling the pneumatic valve 158, the limit being a fully closed position with the pneumatic valve 157 fully open.

A difference between the apparatus 151 of FIG. 14 and the apparatus 136 of FIG. 13 should be noted. The apparatus 136 includes no provision for using lighting heat during periods of low load. Instead, the coil 143 is used for this purpose, which receives heated water from a line 171, whenever required, as indicated by the temperature sensor and controller 147, which positions a by-pass valve 172 to provide the required reheat. Heated water returns from the valve 172 or from the coil 143 through a return line 173.

Figure 15:
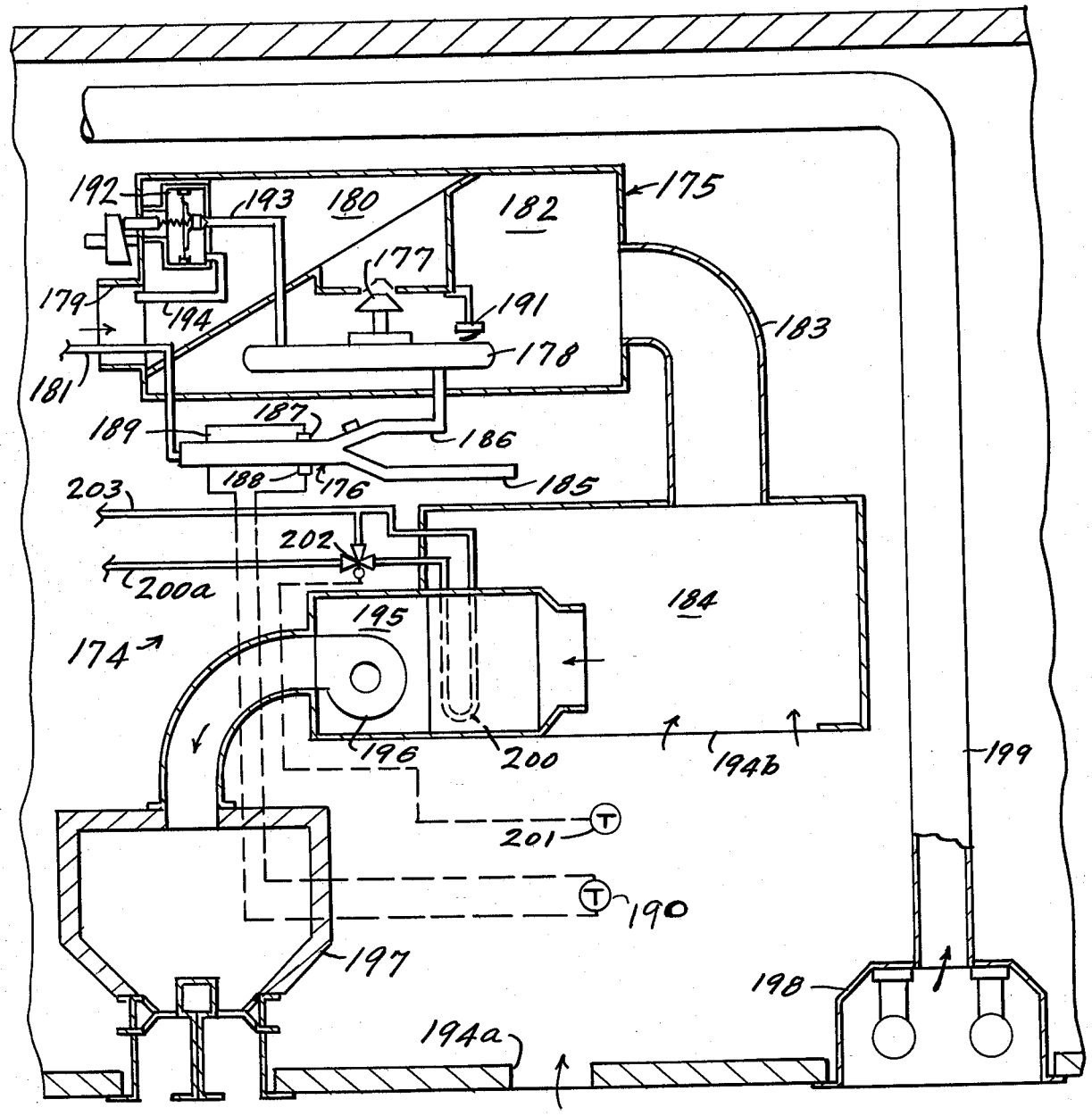
FIG. 15 is a sectional view of a further embodiment of an air conditioning apparatus.

FIG. 15 shows an air conditioning apparatus 174 similar in structure and identical in function to the apparatus 136 of FIG. 13, the difference between the apparatus 174 and the apparatus 136 being the manner in which the inflow of primary conditioned air is controlled. Instead of the pneumatic valves 138 of the air conditioning apparatus 136 of FIG. 13, the apparatus 174 utilizes a conditioned air control unit 175 which includes a fluidic valve 176 and a cone valve 177 operated by an air bag and bellows 178. The control unit 175 is known and commercially available; FIG. 15 illustrates its use in a system according to the invention.

Primary conditioned air flows from a duct 179 into a chamber 180. Conditioned air, which is under a positive pressure, also flows through a line 181 and into the fluidic valve 176 where it is used to control the cone valve 177. Conditioned air from the chamber 180 flows through the valve 177, into a second chamber 182, through a duct 183 and into a mixing area 184.

The cone valve 177 closes and opens, respectively, in response to inflation and deflation of the air bag 178. A small amount of primary air is supplied by the line 181 to the fluidic valve 176, from which it is either vented through a lower tube 185 or directed through an upper tube 186 into the bag 178 for inflation thereof. There are openings through the fluidic valve 176 through which there is communication to the interior of ends 187 and 188 of a tube 189. The fluidic valve 176 is controlled by a self activating thermostat indicated generally at 190 which senses the temperature of the zone being air conditioned and causes the appropriate flow of control air through the lower tube 185 or through the upper tube 186 to inflate the air bag 178. The thermostat 190 can be actuated by a bimetallic element (not illustrated) movable between two positions: one in which air can flow through the tube 189 from the thermostat 190 and the end 188 into the valve 176 while flow through the end 187 is prevented, and a second in which air can flow through the tube 189 from the thermostat 190 and the end 187 into the valve 176 while flow through the end 187 is prevented. Such movement of the thermostat 190 directs air through the upper tube 186 when the zone temperature is too low, and through the lower leg 185 when the zone temperature is too high.

A limit stop 191 is preferably included in the control unit 175 to prevent the cone valve 177 from closing completely. This assures that a minimum flow of conditioned air will always be maintained into the mixing area 184 of the apparatus 174. The conditioned air control unit 175 includes a constant pressure control 192 which is connected to the air bag 178 by a line 193. Conditioned air enters the pressure control 192 through a line 194 and, except when the bag is fully inflated against the stop 191, flows from the pressure control 192 through the line 193 to modulate the bag 178 as required to compensate for variations in primary air pressure and velocity.

Recirculated room air enters the mixing area 184 of the air conditioning apparatus 174 through an opening **194*b*, after having passed from a room into a plenum through an opening 194*a*. Such recirculated room air is then appropriately mixed with conditioned air, as in the apparatus 136 of FIG. 13, and travels through a chamber 195 and a blower 196 to a terminal 197 for delivery into the space. One of the openings 194*a* and 194*b* is appropriately restricted so that the proportional mixing of conditioned air and recirculated air can be controlled by the valve 177, above. As in the above embodiments, the conditioned air entering the space through the terminal 197 displaces an equal amount of room air through lighting fixtures 198 for return to a central air conditioning unit via a duct 199**. The displaced light-heated air may be utilized as described above in connection with other embodiments.

As in the apparatus 136 of FIG. 13, there is no provision in the apparatus 174 for utilizing lighting heat for reheat of conditioned air during periods of low load. For this purpose there is provided a heating coil 200, which receives heated water from a line **200*a*, whenever required, as indicated by a temperature sensor and controller 201 which positions a by-pass valve 202 to provide the required reheat. Heated water returns from the valve 202 or from the coil 200 through a return line 203**.

Figure 16:
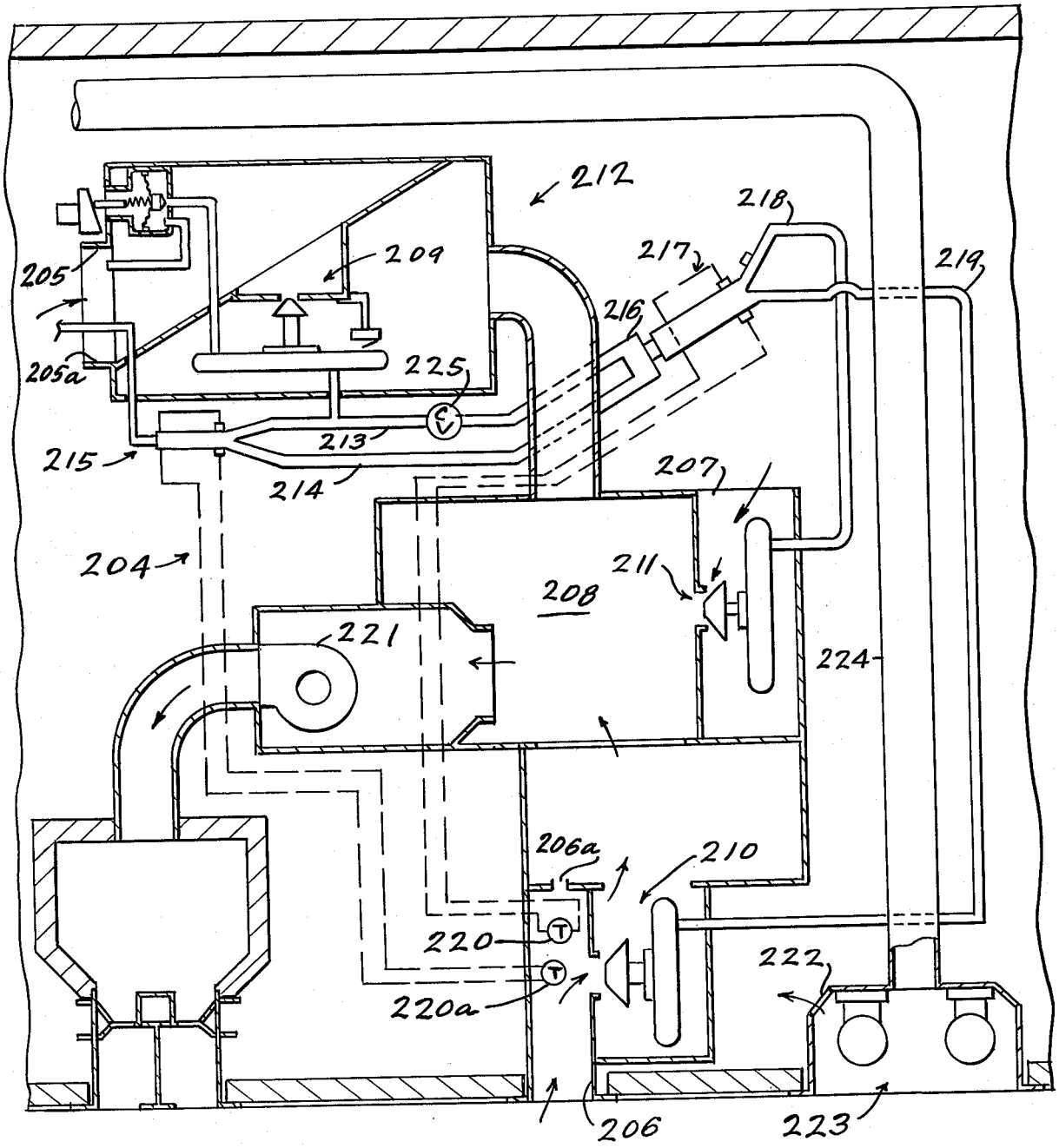
FIG. 16 is a sectional view of another embodiment of an air conditioning apparatus similar to that of FIG. 16.

Referring now to FIG. 16, an air conditioning apparatus 204 similar to the apparatus 151 of FIG. 14 is illustrated. The apparatus 204 includes an opening 205 for receiving primary conditioned air from a duct **205*a*, an opening 206 for receiving recirculated room air, and an opening 207 for receiving plenum air. There is also an air sample opening 206*a* to assure a small flow of room air through the opening 206 to enable the sensing of space temperature. Entry of conditioned air, room air and plenum air into a central mixing area 208 is controlled by cone-and-bellows type valves 209, 210 and 211, respectively, similar to the valve 177 of FIG. 15. Control of primary conditioned air is provided by a control unit 212 identical with the unit 175 of the apparatus 174 described above, except that control air flow tubes 213 and 214 downstream of a fluidic valve 215 are extended to be ultimately joined together a a junction 216 for flow into a second fluidic valve 217. From the second fluidic valve 217, pressurized control air is directed either into a first tube 218, which leads to the cone-and-bellows valve 211 for control of the flow of plenum air therethrough, or to a second tube 219 which leads from the fluidic valve 217 to the cone-and-bellows valve 210 for control of the inflow of room air. Both fluidic valves are controlled similarly to the fluidic valve 176 of FIG. 15, self actuating thermostats 220 and 220*a* being provided at appropriate locations to sense zone temperature and cause the appropriate flow of control air through the fluidic valves. When plenum air is drawn into the mixing area 208 of the apparatus 204 by a blower 221, room air is drawn through an opening 222 in a lighting fixture 223 wherein such air is heated. As in the apparatus 151 of FIG. 14, any relief air displaced by conditioned air delivered into the space will pass upwardly through the lighting fixture 223 into a duct 224**. The displaced light-heated air may be utilized as described above in connection with other embodiments.

The fluidic valve 217 modulates the plenum air valve 211 and the recirculated room air valve 210 in opposition to each other. For example, under maximum air conditioning loads, when the conditioned air valve 209 is wide open, the room air valve 210 is also wide open and the plenum air valve 211 is closed. In this condition the fluidic valve 215 serving the conditioned air valve 209 would direct control air through the lower tube 214, rather than the tube 213, so that the valve 209 will be in the maximum open position. Control air reaching the junction 216 through the tube 214 is prevented from traveling back through the line 213 to pressurize the valve 209 by a check valve 225 in the line 213. The check valve 225 allows air flow through the tube 213 only in the direction of the second fluidic valve 217.

In the maximum load condition described, the second fluidic valve 217 would direct control air through the line 218 to pressurize the plenum air valve 211 so that no plenum air is admitted into the mixing area 208. Consequently, the tube 219 leading from the fluidic valve 217 to the room air valve 210 would not be pressurized and the valve 210 would be open.

The fluidic valves 215 and 217, actuated by the self actuating thermostats 220 and **220*a*, control the conditioned, room and plenum air valves 209, 210 and 211 in a manner identical to that of the apparatus 151 of FIG. 14, except, of course, that the room and plenum air valves 210 and 211** must be modulated in opposition to one another and cannot be both fully open or both fully closed.

Figure 17:
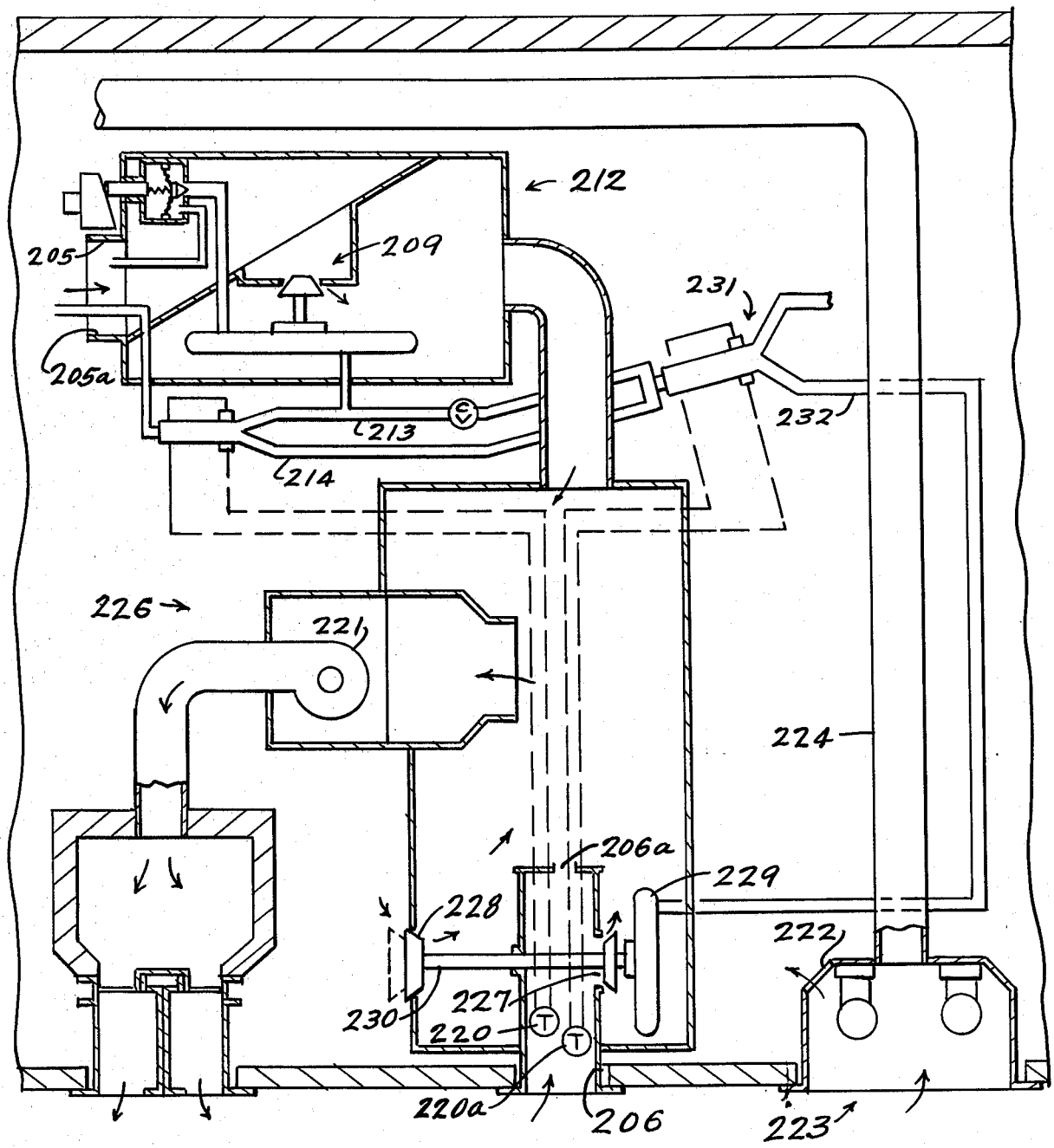
FIG. 17 is a sectional elevational view of still another embodiment of an air conditioning apparatus similar to that of FIG. 16.

FIG. 17 shows an air conditioning apparatus 226 which is a variation of the apparatus 204 of FIG. 16. The only difference is that the room air and plenum air valves 210 and 211 of the apparatus 204 are replaced in the apparatus 226 by room and plenum air valves 227 and 228 which are actuated by a common air bag 229 and connected together by a linking member 230. The linking member 230 is normally biased toward the right in FIG. 17, so that when the air bag 229 is completely depressurized, the plenum air valve 228 is fully closed and the room air valve 227 is fully open. A fluidic valve 231 is capable of delivering control air through a line 232 into the air bag 229. The fluidic valve 231 thus modulates the two air valves 227 and 228 between fully closed on the plenum air valve 228 and fully open on the room air valve 227, and fully open plenum and fully closed room air. The function of the apparatus 226 is thus identical to that of the apparatus 204 of FIG. 16, for various ranges of air conditioning load.

Figure 18:
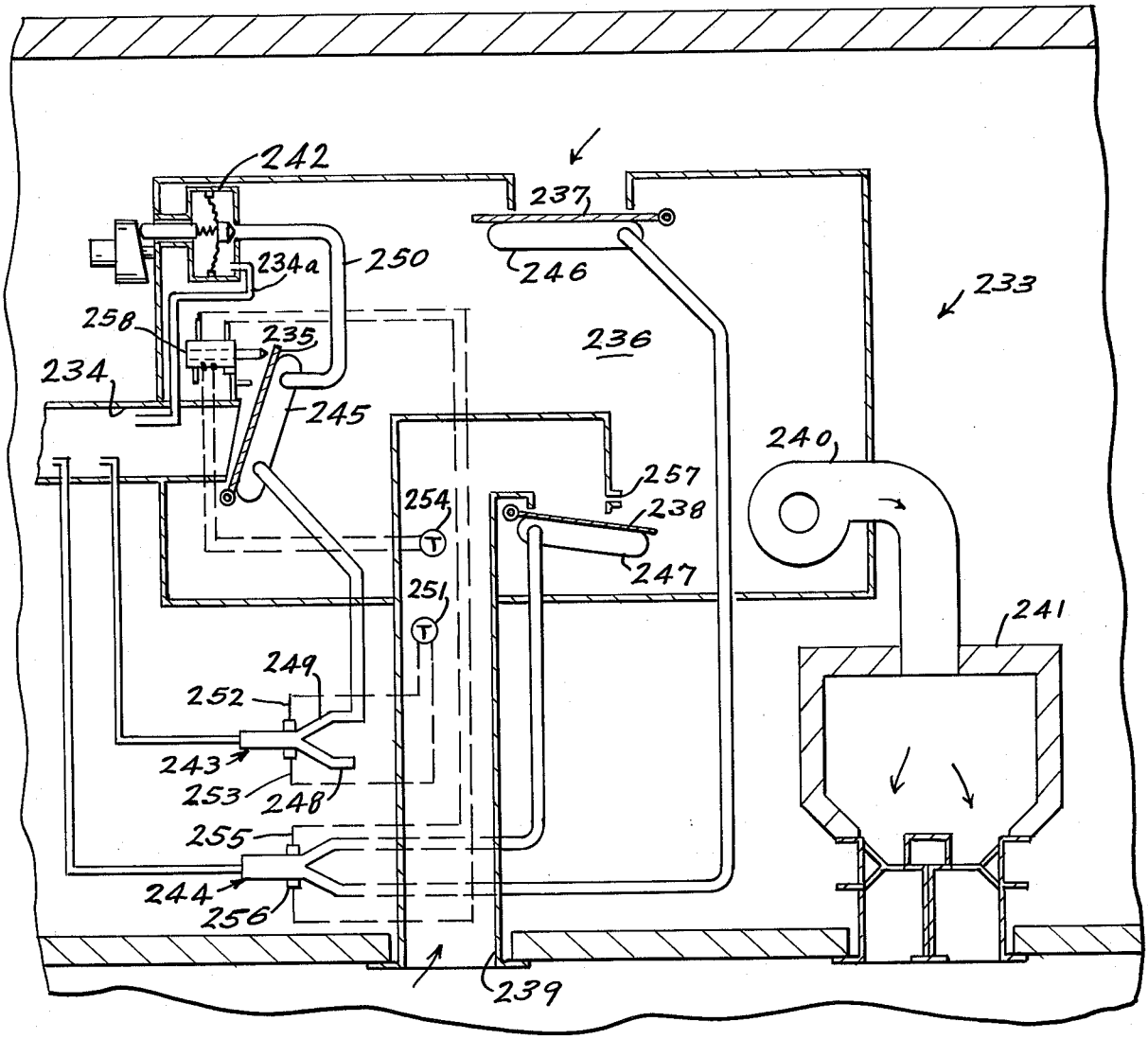
FIG. 18 is a sectional elevational view of yet another embodiment of an air conditioning apparatus similar to that of FIG. 16.

FIG. 18 shows another type of air control valve applied in another variation of the apparatus of FIG. 16. An air conditioning apparatus 233 receives primary conditioned air from a duct 234 leading, through a conditioned air valve 235; to a mixing area 236. Also leading into the mixing area 236 are a plenum air valve 237 and a room air valve 238 which receives recirculated air from a duct 239 in communication with a space to be conditioned. The mixed air is delivered by a blower 240 through a terminal 241 to the space.

As FIG. 18 indicates, the primary conditioned air duct 234 supplies a small amount of control air through a line 234*a* under a positive pressure for a constant pressure control 242 similar to the control 192 of FIG. 15, a fluidic valve 243 and a fluidic valve 244. The fluidic valve 243 serves an air bag 245 which operates the conditioned air valve 235, while the fluidic valve 244 appropriately divides control air between an air bag 246 serving the plenum air valve 237 and an air bag 247 serving the room air valve 238. The fluidic valve 243 is similar to the fluidic valve 231 of FIG. 17, with a tube 248 which vents control air when directed therethrough and a tube 249 operable, when control air is directed therethrough, to inflate the air bag 245 to push the conditioned air valve 235 toward the closed position. The constant pressure control 242 connects to the interior of the air bag 245 via a tube 250, similarly to the connection of the tube 193 in FIG. 15. Controlling the fluidic valve 243 is a self actuating thermostat 251, positioned in the room air duct 239, which senses the temperature of the zone being air conditioned and opens either a tube 252 or a tube 253, each of which communicates with the interior of the fluidic valve 244, to the atmosphere. This causes control air to flow either through the tube 249 or the tube 248, respectively.

Figure 19:
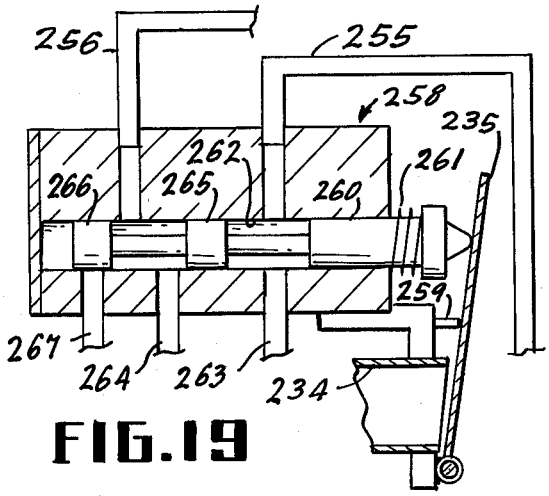
FIG. 19 is an enlarged sectional elevational view of a control valve included in the apparatus of FIG. 19.
Figure 20:
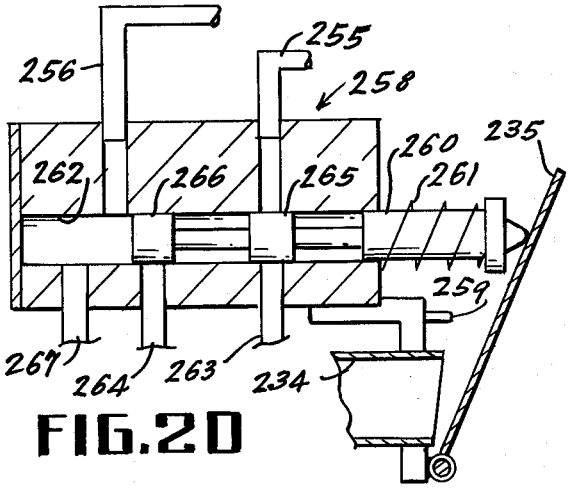
FIG. 20 is a view similar to that of FIG. 20 showing the valve in another position.

The fluidic valve 244 is similar to the fluidic valve 243 and includes a self actuating thermostat 254 capable of opening either a tube 255 or a tube 256 to the atmosphere to direct control air toward the room air valve control bag 247 or the plenum air valve control bag 246, respectively. The thermostat 254 can then modulate the room and plenum air valves 238 and 237 as required in response to temperature of the incoming room air. The room air valve 238 is never completely closed due to a stop 257, so that there is a constant flow of room air past the thermostats 251 and 254. The thermostat 254, however, is not always operable in this embodiment. Its operability depends upon a slide valve assembly 258, the position of which can be controlled by the position of the conditioned air valve 235. The valve assembly 258, which receives the tubes 255 and 256, of the fluidic valve 244 is illustrated in FIGS. 19 and 20. Under minimum air conditioning load conditions, the fluidic valve 243 is operated to fully inflate the air bag 245, thereby closing the conditioned air valve 235 to the maximum extent. The valve 235 is never completely closed, so that the minimum requirements for ventilation of the space are met. To this end, a stop 259 may be provided to define the maximum closed position of the valve 235.

When the conditioned air valve 235 is in the above discussed maximum closure position, illustrated in FIG. 19, the slide valve assembly 258 assumes the position shown. A slidable plunger 260, lightly biased to the right in FIG. 20 by a compression spring 261, is held by the conditioned air valve 235 to a maximum left position wherein the tubes 255 and 256 are placed in communication, through a central bore 262 of the valve 259 with tubes 263 and 264, respectively, leading to the control damper 254. Valve discs 265 and 266 of the plunger 260 are positioned as shown in FIG. 19 so that they do not prevent such communication, with the disc 265 appropriately dividing the flow paths. An atmospheric air opening 267 is closed by the disc 266. This position renders the temperature responsive damper 254 operable in the usual way so that it modulates the plenum air valve 237 and the room air valve 238 in opposition to one another in accordance with the temperature of room air entering the duct 239.

In the embodiment shown in FIG. 18, the plenum air valve 237 and the room air valve 238 are biased downwardly toward the open position, by gravity, and the conditioned air valve 235 is biased toward the open position by the light compression spring 261 included in the slide valve assembly 258. This aids in moving the valves toward the open position when the air bags are relaxed.

Under air conditioning load conditions approaching maximum, plenum air is not needed for reheat and in fact the plenum air valve 237 should be maintained closed. To this end, the plunger 260 of the slide valve 258 is moved by the conditioned air valve 235 and the spring 261 to the position shown in FIG. 20. In this position, the tubes 263 and 264, leading to the thermostat 254, are closed by the valve discs 265 and 266 so that the thermostat 254 is inoperative. The tube 255 is also closed by the disc 265 so that control air is not directed through the fluidic valve 244 toward the room air control bag 247. The tube 256, on the other hand, is opened to the atmosphere via the opening 267. This has the effect of causing a flow of control air through the fluidic valve 244 into the plenum air control bag 246, thereby inflating the bag to maintain the plenum air valve 237 in the closed position.

It should be understood that in certain systems, the room air valve 238 and control air bag 247 are not necessary components of the air conditioning apparatus 233. In such systems, the upper branch of the fluidic valve 244 shown in FIG. 18 would simply be a venting branch, while the lower branch would operate the plenum air valve 237 in the manner described above. Thus, the room air duct 239 would be continually open (with appropriate restriction for mixture control) to the mixing area 236, thereby lowering the reheat capability of the apparatus 233. If the system in which the apparatus 233 is included can be adequately served with this lower reheat capability, then the modified, simpler form of the apparatus 233 should be used.

In operation of the apparatus 233 of FIGS. 18, 19 and 20, the air valves 235, 237 and 238 are modulated by the thermostats 251 and 254 to provide, in effect, partial settings. For example, in air conditioning load conditions between minimum and intermediate, i.e., not requiring conditioned air beyond the minimum required for ventilation, the conditioned air damper 235 is at the minimum open position shown in FIG. 19, as discussed above. The thermostat 254 is thus operative, modulating the plenum and room air valves 237 and 238 in response to temperature of air passing through the duct 239. The thermostats 251 and 254 are capable of assuming substantially only two positions: one directing control air through one side of the respective fluidic valve, and the other directing air through the opposite side. Partial settings of the thermostats do not occur for significant periods. Thus the thermostat 254 is continually moving from one position to the other as too low and too high temperatures are sensed. The air bags 246 and 247 are slow to inflate and deflate, so that while a bag is moving in one direction, the temperature condition in the space may be corrected. Thus, the thermostat will have reversed its position before either bag goes to the maximum closed or open position, assuming a space load somewhere between minimum and intermediate. In this way, by continually changing its position, the thermostat 254 provides the equivalent of partial air valve settings.

If during the load condition described above, the load increases abruptly (as by increase of solar load), air several degrees warmer will begin passing through the duct 239, and the thermostat 254 will assume a position for inflating of the plenum air bag 246 and deflation of the room air bag 247. At the same time, the thermostat 251 will assume a position for deflation of the conditioned air bag 245. However, the bags inflate and deflate slowly, and if the air conditioning load is actually still in the minimum to intermediate range, the conditioned air valve will be open for only a short time and may not even reach a position far enough open to move the assembly 258 to the position shown in FIG. 20. Thus, the thermostat 254 will usually remain operative through minor increases in load.

However, if in fact the load is increased into the intermediate to maximum range, the conditioned air valve 235 will open far enough to move the slide valve 258 to the position of FIG. 20, thereby rendering the thermostat 254 inoperative, closing the plenum air valve 237 and allowing the room air valve 238 to open fully. The conditioned air valve 235 will then modulate as required according to the temperature of air sensed by the thermostat 251. If the temperature of the air in the duct 239 drops a few degrees, the thermostat 251 will cause the conditioned air bag 245 to begin inflating. The thermostat 254 will also react to the temperature change, but it is not operative under these load conditions. Because of the lag in reaction of the conditioned air valve 235, due to slow inflation of the air bag 245, the thermostat 254 will remain inoperative unless and until the air conditioning load actually drops significantly.

It will be appreciated that the valve assembly 258 can also be positively driven between the positions shown in FIGS. 19 and 20, as discussed in connection therewith. For example, a solenoid (not illustrated) can be provided to hold the FIG. 19 position whenever a switch (not illustrated) is closed by the conditioned air valve 235. Such operation has the advantage of moving the assembly between the two positions (FIGS. 19 and 20) rapidly, and independent of the rate at which the air valve 235 moves.

Referring again to FIG. 14, the controller 168 senses the temperature of the zone 162 served by the apparatus 151, and bleeds compressed air from a source (not illustrated) as required, to achieve temperature control. The compressed air flows through a line 268 and a line 269 to the controller 168, and is bled thereby into a pressure control system comprising lines 270, 271 and 272, or bled from the pressure system, to accomplish control. For example, the controller 168 can bleed compressed air into the lines 270, 271 and 272 whenever the temperature in the zone 162 is above the control temperature, and can bleed air from the lines when the temperature is below the control temperature. In this manner, the air pressure in the lines 270, 271 and 272 can be varied between, say, 1 psig. and 10 psig. as the air conditioning load on the zone 162 varies between a minimum load and a maximum load. The actuator 165 can control the pneumatic 156 to provide the minimum flow of conditioned air required for ventilation as the air pressure in the line 270 varies between 1 and 4 psig., to position the valve 156 in a fully open position when pressure is 10 psig., and to position the valve 156 at intermediate positions when the pressure in the line 270 is intermediate between 4 and 10 psig. Similarly, the actuator 166 can position the pneumatic valve 154 fully open when the pressure in the line 272 is 1 psig., in a fully closed position as the pressure varies between 4 and 10 psig., and at positions intermediate between open and closed as the pressure varies between 1 and 4 psig. Likewise, the actuator 167 can position the pneumatic valve 158 in a fully closed position when the pressure in the line 271 is 1 psig., in a fully open position when the pressure is from 4 to 10 psig., and at intermediate positions when the pressure is between 1 and 4 psig. The controller 168 can also operate in a reverse direction, bleeding air into the lines 270, 271 and 272 when the temperature sensed is below the control temperature, and bleeding air from said lines when the sensed temperature is above control temperature. In this case, the pressure in the lines 270, 271 and 272 can vary between, say, 10 psig. at minimum load and 1 psig. at maximum load.

It will be appreciated that the control system disclosed in FIG. 14, and described in connection therewith, accomplishes control of the temperature of the zone 162 in a manner that is functionally equivalent to that by which zone control is accomplished in the apparatus of FIGS. 18–20. Control of the FIG. 14 apparatus, however, depends upon compressed air, while control of the apparatus of FIGS. 18–20 involves nothing more than the use of small quantities of primary conditioned air which by necessity is delivered to the space zones for air conditioning purposes. Accordingly, control as described in connection with FIGS. 18–20 is preferred, particularly in buildings where compressed air is not required for other purposes, i.e., purposes other than control of the air conditioning system.

Figure 21:
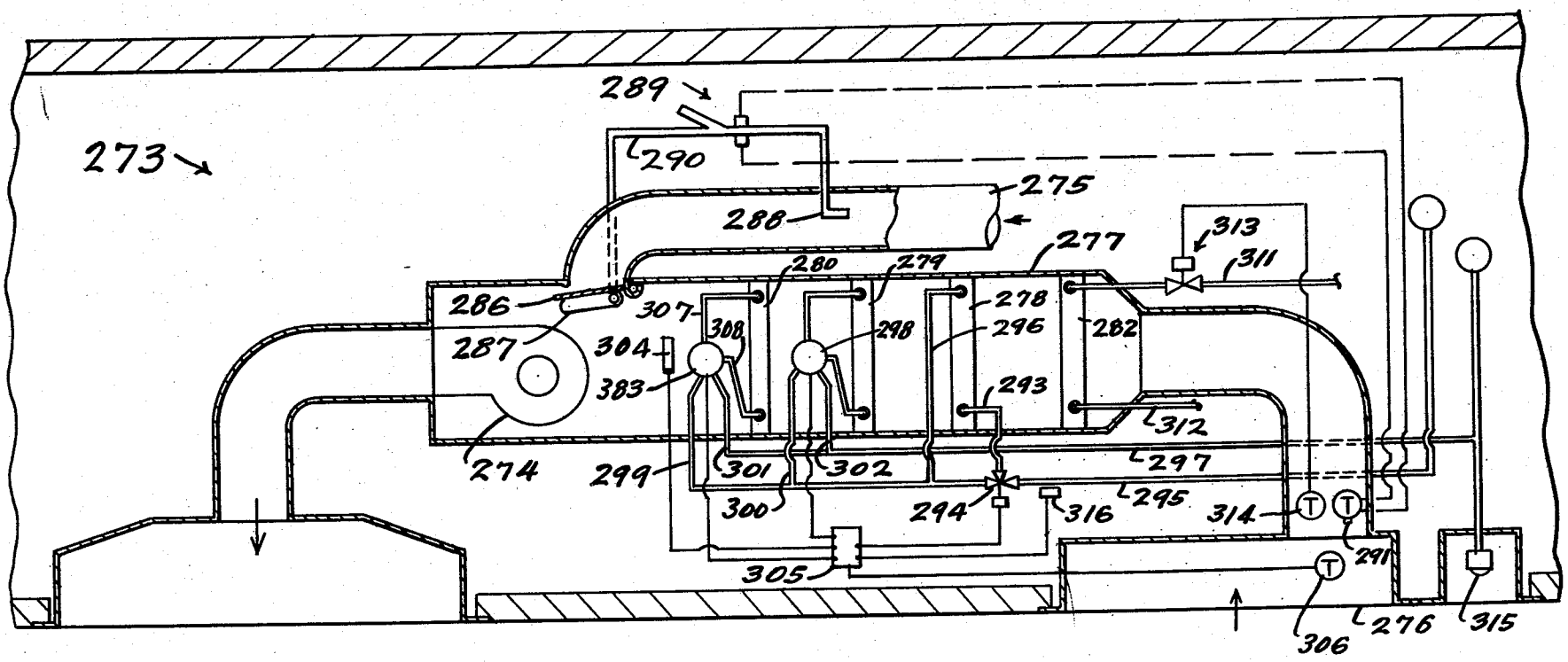
FIG. 21 is a sectional elevational view of still another embodiment of an air conditioning apparatus.

FIG. 21 shows an air conditioning apparatus 273, particularly suited for use in a zone of a building where the air conditioning load can increase by a large increment within a short period of time. This condition may occur in a computer room, for example, where the load, when the computer is in operation, may be nearly double that when the computer is not operating. The apparatus 273 includes a blower 274 which receives a mixture of primary conditioned air from a duct 275 with a greater or lesser proportion of recirculated room air which enters through an opening 276 into an enclosure 277 and flows therethrough to the inlet of the blower 274. Recirculated air flowing through the enclosure 277 is in contact with a series of heating and cooling coils. Preferably included in the enclosure 277 are a cooling coil 278 and first and second refrigerated coils 279 and 280. Also positioned in the path of the circulated air flowing within the enclosure 277 is at least one heating coil for providing reheat, when required. The heating coil may be a hot water heating coil 282 which may derive heat from water cooled lighting fixtures (not shown) or from another source of heated water, or the cooling coil 280 which may receive heated refrigerant from a combined compressor-condenser 283 when operated as a heat pump.

Under ordinary conditions of summer operation, and when the air conditioning load is comparatively low, e.g., because the computer is not in operation, the heating coil 282, the cooling coil 278 and the refrigerated cooling coils 279 and 280 are all out of operation, and a conditioned air valve 286 is modulated as required to control temperature. The room air opening 276 is sized to provide the appropriate resistance to room air flow so that at full opening of the conditioned air valve 286, nearly all of the air delivered to the room by the blower 274 is conditioned air. However, space air always flows through the room air opening 276.

The conditioned air valve 286 is controlled by an air bag 287 which is inflated to move the valve toward closure, when appropriate, by control air entering a tube 288 and passing through a fluidic valve 289. A lower branch 290, or the fluidic valve 289 is connected to the air bag 287. A self actuating thermostat 291 controls the fluidic valve 289 in the manner discussed above in connection with other embodiments.

The cooling coil 278 is connected by a line 293 through a diverting valve 294 to a line 295, which is connected to a source (not illustrated) of cooling water. When outside conditions are such that water, for example, from an evaporative cooler, can be supplied to the line 295 at about 55° F, it is not necessary to utilize either of the refrigerated cooling coils 279 and 280 under conditions of moderately heavy air conditioning load. Instead, the diverting valve 294 can be modulated to furnish cool water, as required, from the line 295 to the coil 278 to maintain a control temperature in the space being air conditioned. Water from the coil 278 flows through a line 296 back to the supply line 295 and ultimately, or subsequently described, to a return line 297.

The combined compressor-condenser 283 serving the refrigerated coil 280 is preferably of a somewhat low capacity, e.g., 1 ton. The refrigerated coil 279 is served by a combined compressor-condenser 298 which is of somewhat higher capacity, e.g., 1½ ton. Cooling water flows to the condensers of both the combined compressor-condensers 283 and 298 via the line 295, after flowing through the coil 278 when that coil is operating, then through the diverting valve 294 and lines 299 and 300. Lines 301 and 302 return water from the condensers to the building return line 297. When the room air conditioning load or the temperature of the water in line 295 increases to the point that the cooling water from the line 295 passing through the cooling coil 278 is no longer sufficient, in connection with the conditioned air supplied through the fully opened conditioned air valve 286, to handle the load, the smaller combined compressor-condenser unit 283 is activated. The diverting valve 294, the compressor-condenser 283 and the compressor-condenser 298 are all controlled by a temperature sensor 304, a controller 305 and a temperature sensor 306. When the temperature read by the sensor 306 is too high, the controller 305 does one or a combination of the following: (1) sets the diverting valve 294 to direct water to the cooling coil 278, (2) energizes the compressor-condenser 283, (3) energizes the compressor-condenser 298, and (4) decreases the hot gas by-pass around the compressor of the compressor-condenser 298 until full capacity is reached. When the temperature sensed by the sensor 304 is too low, the controller 305 does one or a combination of the following: (1) increases the hot gas bypass around the compressor of the compressor-condenser 298, (2) de-energizes the compressor-condenser 298, (3) de-energizes the compressor-condenser 283 and (4) sets the diverting valve 294 to bypass the cooling coil 278. Energizing the compressor of the compressor-condenser 283 causes cool refrigerant under pressure to flow from the condenser through a line 307 to the refrigerated coil 280, where it is expanded. Refrigerant returns from the coil 280 through a line 308 to the compressor of the compressor-condenser 283. The coil 279 is cooled similarly. The expansion of refrigerant can be controlled to maintain the coils 279 and 280 at a temperature of about 65° F. Since, it is previously dehumidified space air that is cooled by the coil 280, no moisture is condensed externally on the coil 279 or 280 at 65° F. Accordingly there is no need to make provision for the disposition of condensate.

As the load on the air conditioning apparatus 273 fluctuates, but remains in excess of that which can be handled without refrigeration, the compressor-condenser 283 is turned on and off, as required, by the controller 305, which responds to signals from the sensors 304 and 306. The controller 305 preferably operates the compressor to provide, in conjunction with the cooling coil 278, a constant temperature output of recirculated room air at about 65° F. to the blower 274. Even if the cooling water supplied through the line 295 exceeds 65° F., the cooling coil 278 can still be operated to help reduce the temperature of recirculated room air. The recirculated air entering the opening 276 may be at temperatures up to about 80° F., so that the cooling water from the line 295 supplied to the coil 278 can be effective up to about 75° F. to help cool recirculated air.

When the combined cooling effect of the cooling coil 278, the refrigerated coil 280 served by the compressor of the smaller compressor-condenser unit 283, and the conditioned air from the duct 275 are not sufficient to handle the air conditioning load, the larger compressor-condenser 298 is brought into service. The sensor 306 senses too high a temperature and the controller determines that a temperature rise has occured even though the three above-mentioned cooling components are fully active; the controller 305 then energizes the compressor-condenser 298 and de-energizes the smaller compressor-condenser 283. The compressor of the unit 298 delivers cool refrigerant under pressure to be expanded in the refrigerated coil 279 in the same manner as with the refrigerated coil 280 discussed above. The larger compressor-condenser 298, unlike the smaller unit 283, preferably includes a hot gas compressor bypass capable of reducing its output capacity to various levels below full capacity. Thus, when air conditioning load varies but cooling is still required in addition to conditioned air and the cooling coil 278, the controller 305 controls the unit 298 in hot gas bypass to full capacity mode to maintain temperature control.

Under very low air conditioning load conditions, when reheat of room air is required, the conditioned air valve 286 is reduced to the minimum setting required for ventilation and a recirculated air heater is activated. The heating coil 282 is connected to lines 311 and 312 which are, respectively, supply and return lines for heated water. The coil 282 is controlled by a valve 313 which is appropriately connected to a temperature sensor 314. As an alternative to the heating coil 282, the compressor-condenser 283 can be operated as a heat pump to furnish heat to the coil 280. Of course, the coil 283 can be connected to the smaller compressor-condenser 284, as shown, or alternatively, to the larger unit 298.

The supply and return water lines 295 and 297 can advantageously be a part of a water supply system which furnishes water for sprinkler heads, one of which is designated 315, distributed throughout the building.

The apparatus 273 also includes a strap-on type thermostat 316 which senses the temperature of the available cooling water in the line 295. Whenever the thermostat 316 senses a water temperature higher than about 75° F., or such other temperature as may be appropriate, the controller 305 positions the diverter valve 294 to prevent the flow of water from the line 295 through the coil 278.

As an alternative, apparatus similar to the apparatus 273 can have an air inlet from a plenum, rather than from the space being conditioned, but be otherwise identical. Such alternative apparatus is well adapted to be used in conjunction with lights from which heat is transferred to a heat transfer fluid, usually circulated water, e.g. that circulated in the lines 295 and 297. The temperature of the plenum and, consequently, the temperature of the air entering the alternative apparatus can be controlled by controlling the transfer of lighting heat to the circulated fluid. In this manner another reheat mode can be added to the alternative apparatus.

It will be appreciated that the blower 274 in the apparatus of FIG. 21 is analogous, for example, to the restricting orifice 19 of the induction unit 10 of FIGS. 1 through 4 and to the restriction 75 of the inductor 67 of FIG. 8 in the sense that all are used to induce a flow of air, e.g. from a space being air conditioned or from a plenum associated therewith, for mixture with conditioned air; in all cases it is this mixture that is delivered to the space being conditioned. It will also be appreciated, therefore, that appropriately connected blowers can be used in all apparatus according to the instant invention wherein such a flow of air is specifically disclosed as being induced by a Bernoulli effect caused, for example, by a flow of conditioned air through nozzles. This point is illustrated by a comparison of a part of the apparatus shown in FIG. 13 with the apparatus of FIG. 11 and of a part of the apparatus of FIG. 14 with the apparatus 10 of FIGS. 1 through 4, as previously explained in more detail.

I claim:

1. Apparatus for delivering air for air conditioning a zone of a building, said apparatus comprising, in combination, a chamber operatively connected to receive a first stream of primary, conditioned air and to deliver such air to the zone, means associated with said chamber operable to cause such air being delivered to the zone to induce a flow of air from within said chamber for mixture and delivery to the zone with such primary conditioned air, means providing a path for circulation of air from the zone to the interior of said chamber, means operable to deliver a second stream of primary, conditioned air to the interior of said chamber, and means for controlling the flow of air through said means providing a path and through said means operable to deliver a second stream of primary air.

2. Apparatus for delivering air for air conditioning a zone of a building, said apparatus comprising, in combination, a chamber operatively connected to receive a first stream of primary, conditioned air and to deliver such air to the zone, means associated with said chamber operable to cause such air being delivered to the zone to induce a flow of air from within said chamber for mixture and delivery to the zone with such primary conditioned air, means providing a first path for circulation of air from the zone to the interior of said chamber, means providing a second path for circulation of air from the zone to the interior of said chamber, means for heating air circulating through said means providing a second path, means operable to deliver a second stream of primary, conditioned air to the interior of said chamber, and means for controlling the flow of air through said means providing first and second paths and through said means operable to deliver a second stream of primary air.

* * * * *